US010264886B2

(12) United States Patent
Masunaga

(10) Patent No.: US 10,264,886 B2
(45) Date of Patent: Apr. 23, 2019

(54) REACTION FORCE MECHANISM AND CHAIR USING SAME

(71) Applicant: OKAMURA CORPORATION, Yokohama-shi, Kanagawa (JP)

(72) Inventor: Hiroshi Masunaga, Yokohama (JP)

(73) Assignee: OKAMURA CORPORATION, Kanagawa (JP)

( * ) Notice: Subject to any disclaimer, the term of this patent is extended or adjusted under 35 U.S.C. 154(b) by 10 days.

(21) Appl. No.: 15/543,503

(22) PCT Filed: Jan. 5, 2016

(86) PCT No.: PCT/JP2016/050112

§ 371 (c)(1),
(2) Date: Jul. 13, 2017

(87) PCT Pub. No.: WO2016/114171

PCT Pub. Date: Jul. 21, 2016

(65) Prior Publication Data

US 2018/0008046 A1 Jan. 11, 2018

(30) Foreign Application Priority Data

Jan. 16, 2015 (JP) ..... 2015-006878

(51) Int. Cl.
*A47C 3/026* (2006.01)
*A47C 7/44* (2006.01)

(52) U.S. Cl.
CPC ..... *A47C 3/026* (2013.01); *A47C 7/44* (2013.01); *A47C 7/441* (2013.01)

(58) Field of Classification Search
CPC ..... A47C 3/026; A47C 7/44; A47C 7/441; A47C 7/443; A47C 7/444; A47C 7/445; A47C 7/4454; A47C 7/446; A47C 7/448
See application file for complete search history.

(56) References Cited

U.S. PATENT DOCUMENTS 2,087,253 A * 7/1937 Herold ..... A47C 3/026 248/575
3,504,881 A * 4/1970 Aspa ..... B60N 2/502 248/575

(Continued)

FOREIGN PATENT DOCUMENTS

JP 2006-109999 A 4/2006
JP 2007-135625 A 6/2007
JP 4133072 B2 6/2008

OTHER PUBLICATIONS

European Search Report dated Jul. 26, 2018 issued in European App. No. 16737242.4.

*Primary Examiner* — Philip F Gabler
(74) *Attorney, Agent, or Firm* — Nixon Peabody LLP; Jeffrey L. Costellia

(57) ABSTRACT

A pivot shaft (10) which is a first shaft member coupled to a supporting member, an inner cylinder (12) which is a second shaft member coupled to a supported member, and an outer cylinder (14) which is a third shaft member are disposed to be approximately coaxial with each other and disposed radially in multiple layers. The pivot shaft (10) and the inner cylinder (12) are coupled to each other through a first rubber-like elastic member (11), and the inner cylinder (12) and the outer cylinder (14) are coupled to each other through a second rubber-like elastic member (13). The total reaction force is increased by restricting the rotation of the outer cylinder (14) by means of an operating pin (19) which is a reaction force adjusting part and thereby adding a reaction force resulting from the second rubber-like elastic member (13) to a base reaction force resulting from the first rubber-like elastic member (11).

11 Claims, 24 Drawing Sheets

(56) References Cited

U.S. PATENT DOCUMENTS

| | | | | |
|---|---|---|---|---|
| 3,881,772 | A * | 5/1975 | Mohrman | A47C 3/026 248/609 |
| 4,597,567 | A * | 7/1986 | Racca | A47C 3/025 248/397 |
| 4,818,019 | A * | 4/1989 | Mrotz, III | A47C 3/026 248/575 |
| 6,585,320 | B2 * | 7/2003 | Holbrook | A47C 3/026 297/300.4 |
| 7,243,993 | B2 * | 7/2007 | Igarashi | A47C 1/03 297/300.1 |
| 7,726,740 | B2 * | 6/2010 | Masunaga | A47C 1/03255 297/300.4 |
| 2018/0008046 | A1 * | 1/2018 | Masunaga | A47C 3/026 |

* cited by examiner

REACTION FORCE MECHANISM AND CHAIR USING SAME

CROSS-REFERENCE TO RELATED APPLICATIONS

This application is the U.S. national phase of International Patent Application No. PCT/JP2016/050112, filed Jan. 5, 2016, which claims the benefit of Japanese Patent Application No. 2015-006878, filed Jan. 16, 2015, the contents of which are incorporated by reference herein in their entirety.

TECHNICAL FIELD

The present invention relates to a reaction force mechanism capable of adjusting a reaction force acting between a supporting member and a supported member, and a chair using the same.

Priority is claimed on Japanese Patent Application No. 2015-006878 filed Jan. 16, 2015, the content of which is incorporated herein by reference.

BACKGROUND ART

Among chairs used in offices and the like, there are chairs in which a backrest is tiltably attached to a support structure. Further, as a chair of this type, a chair in which a support structure which is a supporting member and a backrest which is a supported member are connected via a reaction force mechanism capable of adjusting a reaction force is known (for example, refer to Patent Document 1).

The reaction force mechanism disclosed in Patent Document 1 has a structure in which a plurality of unit biasing parts are provided in a pivotally connecting portion between a supporting member (support structure) and a supported member (backrest) in an axial direction of a pivot shaft and a combination of the unit biasing parts which causes a reaction force to be effective between the supporting member and the supported member can be selected by an operation lever. The reaction force mechanism is a mechanism which adjusts the reaction force acting between the supporting member and the supported member by switching the effective combination of the unit biasing parts. Therefore, as compared with a mechanism which adjusts the reaction force by changing an initial load of a single biasing part, it is possible to reduce an operation force required to adjust the reaction force.

CITATION LIST

Patent Document

[Patent Document 1]
Japanese Patent No. 4133072

SUMMARY OF INVENTION

Technical Problem

However, in the reaction force mechanism disclosed in Patent Document 1, when an axial length of the pivot shaft is limited, the axial length of the unit biasing part should be shortened and a switching mechanism should also be arranged within the limited axial length due to a structure in which the plurality of unit biasing parts are arranged in the axial direction of the pivot shaft. Accordingly, strict design accuracy is required, which may increase manufacturing cost.

Therefore, an object of the present invention is to provide a reaction force mechanism which does not require a high degree of design accuracy and in which a reaction force acting between a supporting member and a supported member can be easily changed, and a chair using the same.

Solution to Problem

In order to achieve the aforementioned objects, according to an aspect of the present invention, there is provided a reaction force mechanism which is provided between a supporting member and a supported member supported by the supporting member to be tiltable and is capable of adjusting a reaction force resulting from the tilting movement of the supported member with respect to the supporting member, including a plurality of shaft members including a first shaft member connected to the supporting member, a second shaft member connected to the supported member and a third shaft member other than the first shaft member and the second shaft member and disposed coaxially and radially in multiple layers; a plurality of biasing members configured to connect the shaft members adjacent to each other in a radial direction; and a reaction force adjusting part configured to increase the reaction force against a base reaction force resulting from the biasing member interposed between the first shaft member and the second shaft member by restricting rotation of the third shaft member with respect to the first shaft member or the second shaft member.

Due to such a constitution, when the reaction force acting between the supporting member and the supported member is adjusted, the reaction force can be increased against the base reaction force resulting from the biasing member interposed between the first shaft member and the second shaft member by restricting the rotation of the third shaft member by means of the reaction force adjusting part.

Since the first shaft member, the second shaft member and the third shaft member are approximately coaxial with each other and disposed radially in multiple layers, even when an axial space is limited, an axial length of each of the shaft members and the biasing member interposed between the adjacent shaft members can be sufficiently secured.

The first shaft member may be constituted by a shaft member in an innermost layer, the second shaft member may be constituted by a shaft member disposed radially outside the first shaft member to be adjacent thereto, the third shaft member may be constituted by a shaft member disposed radially outside the second shaft member to be adjacent thereto, and the reaction force adjusting part capable of adjusting rotation of the third shaft member may be provided at the supporting member.

In this case, in a state in which the reaction force adjusting part does not restrict the rotation of the third shaft member, the third shaft member is rotated and displaced following the adjacent second shaft member, and the biasing member interposed between the second shaft member and the third shaft member does not generate a reaction force. Therefore, when the supported member is tilted with respect to the supporting member in this state, only a base reaction force of the biasing member interposed between the first shaft member and the second shaft member acts. Meanwhile, in a state in which the reaction force adjusting part restricts the rotation of the third shaft member, when the supported member is tilted with respect to the supporting member, the second shaft member rotates relative to the first shaft member and the third shaft member, and the reaction force of the biasing member interposed between the second shaft member and the third shaft member is added to that of the biasing member interposed between the first shaft member and the second shaft member. As a result, the reaction force between the supported member and the supporting member is adjusted to be increased.

The second shaft member may be constituted by a shaft member in an innermost layer, the third shaft member may be constituted by a shaft member disposed radially outside the second shaft member to be adjacent thereto, the first shaft member may be constituted by a shaft member disposed radially outside the third shaft member to be adjacent thereto, and the reaction force adjusting part capable of adjusting rotation of the third shaft member may be provided at the supporting member.

In this case, when the supported member is tilted with respect to the supporting member in a state in which the reaction force adjusting part does not restrict the rotation of the third shaft member, the third shaft member is rotated and replaced following the adjacent second shaft member, and the biasing member between the second shaft member and the third shaft member and the biasing member between the third shaft member and the first shaft member are connected in series and generate the base reaction force. Meanwhile, when the reaction force adjusting part restricts the rotation of the third shaft member, the relative rotation does not occur between the first shaft member and the third shaft member. Accordingly, when the supported member is tilted with respect to the supporting member in this state, the biasing member between the second shaft member and the third shaft member generates the reaction force by itself. As a result, the reaction force between the supported member and the supporting member is adjusted to be increased.

An axial length of one of the plurality of shaft members which is disposed radially inward may be set to be longer than that of the shaft member which is disposed radially outward.

In this case, the shaft member disposed inward in the radial direction protrudes outward from an axial end of the shaft member disposed outward in the radial direction. Accordingly, the shaft member disposed inward in the radial direction can be easily positioned with respect to the supported member or the supporting member.

The biasing member may be a rubber-like elastic member which is filled between the shaft members radially adjacent to each other and bonded to the shaft members disposed radially inward and outward.

In this case, when the relative rotation occurs between the shaft members adjacent to each other in the radial direction, the entire rubber-like elastic member is approximately evenly twisted and deformed. Therefore, a stable reaction force can be obtained while a compact structure is provided.

An outer end surface of the rubber-like elastic member in an axial direction may be inclined axially outward with respect to a direction orthogonal to the axial direction.

In this case, since an axial cross section of the rubber-like elastic member between the shaft members disposed radially outward and inward has an approximate trapezoidal shape, axial misalignment of the shaft members hardly occurs. Therefore, even when the relative rotation occurs between the shaft members adjacent to each other in the radial direction, the reaction force can be more stably obtained.

In order to achieve the aforementioned objects, according to another aspect of the present invention, there is provided a chair in which a backrest is attached to a support structure to be tilted, wherein the backrest is attached to the support structure via any one of the above-described reaction force mechanisms.

Advantageous Effects of Invention

According to the present invention, the first shaft member, the second shaft member and the third shaft member are approximately coaxial with each other and are disposed radially in multiple layers, and the rotation of the third shaft member is restricted by the reaction force adjusting part. Therefore, since the total reaction force can be adjusted by increasing the reaction force against the base reaction force, an axial length of each of the shaft members and the biasing member can be sufficiently secured even when an axial space is limited. Therefore, the reaction force acting between the supporting member and the supported member can be easily changed without a high degree of design accuracy.

DESCRIPTION OF EMBODIMENTS

Figure 1:
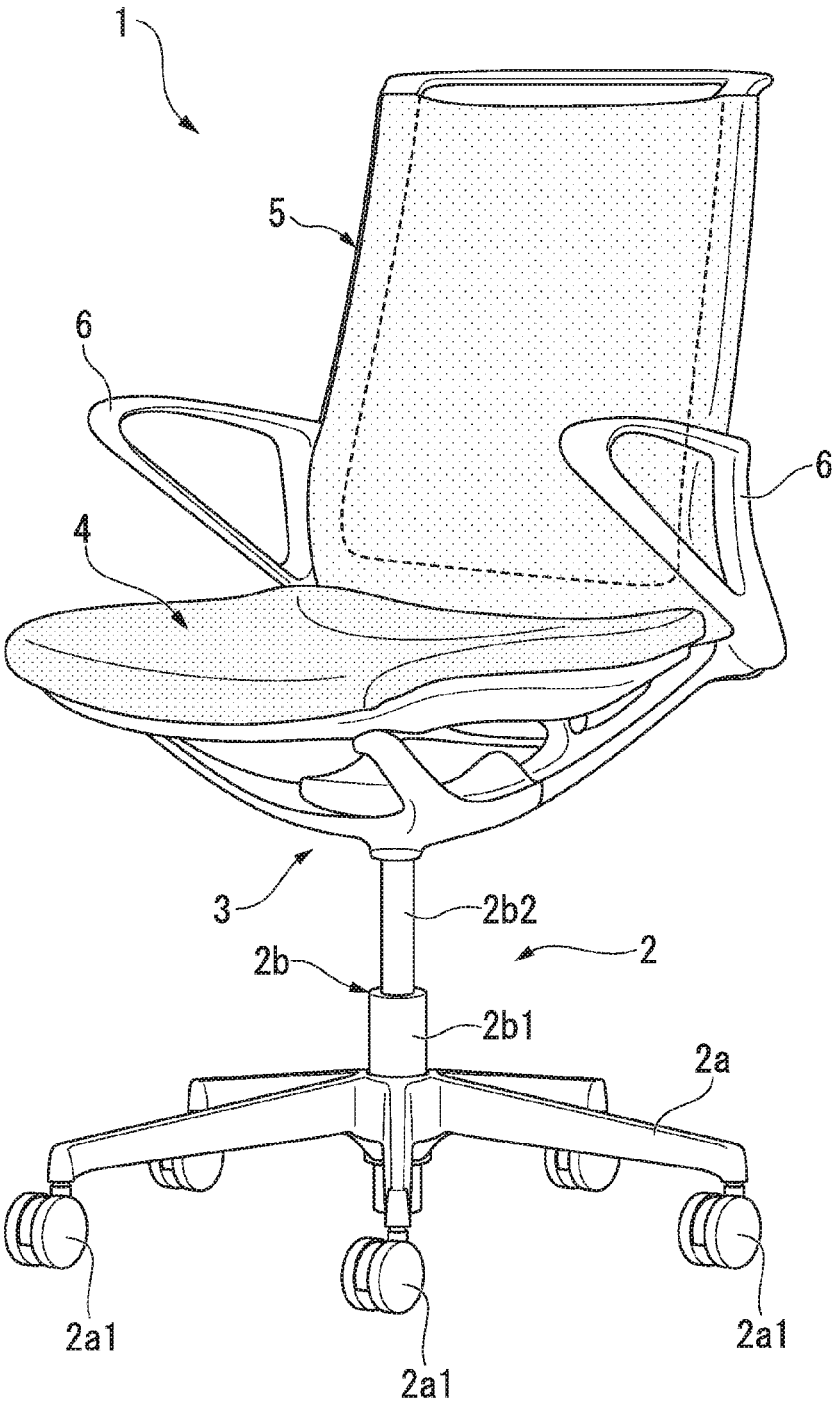
FIG. 1 is a perspective view of a chair according to a first embodiment of the present invention as seen from a front surface side thereof.

Hereinafter, embodiments of the present invention will be described on the basis of the accompanying drawings. Further, in the following description of each embodiment, forward, backward, upward, downward, left and right directions are directions seen by a user seated in a chair unless otherwise specified. Furthermore, in each embodiment described below, the same reference numerals are provided for the same parts, and repeated description thereof will be omitted.

First, a first embodiment shown in FIGS. 1 to 10 will be described.

Figure 2:
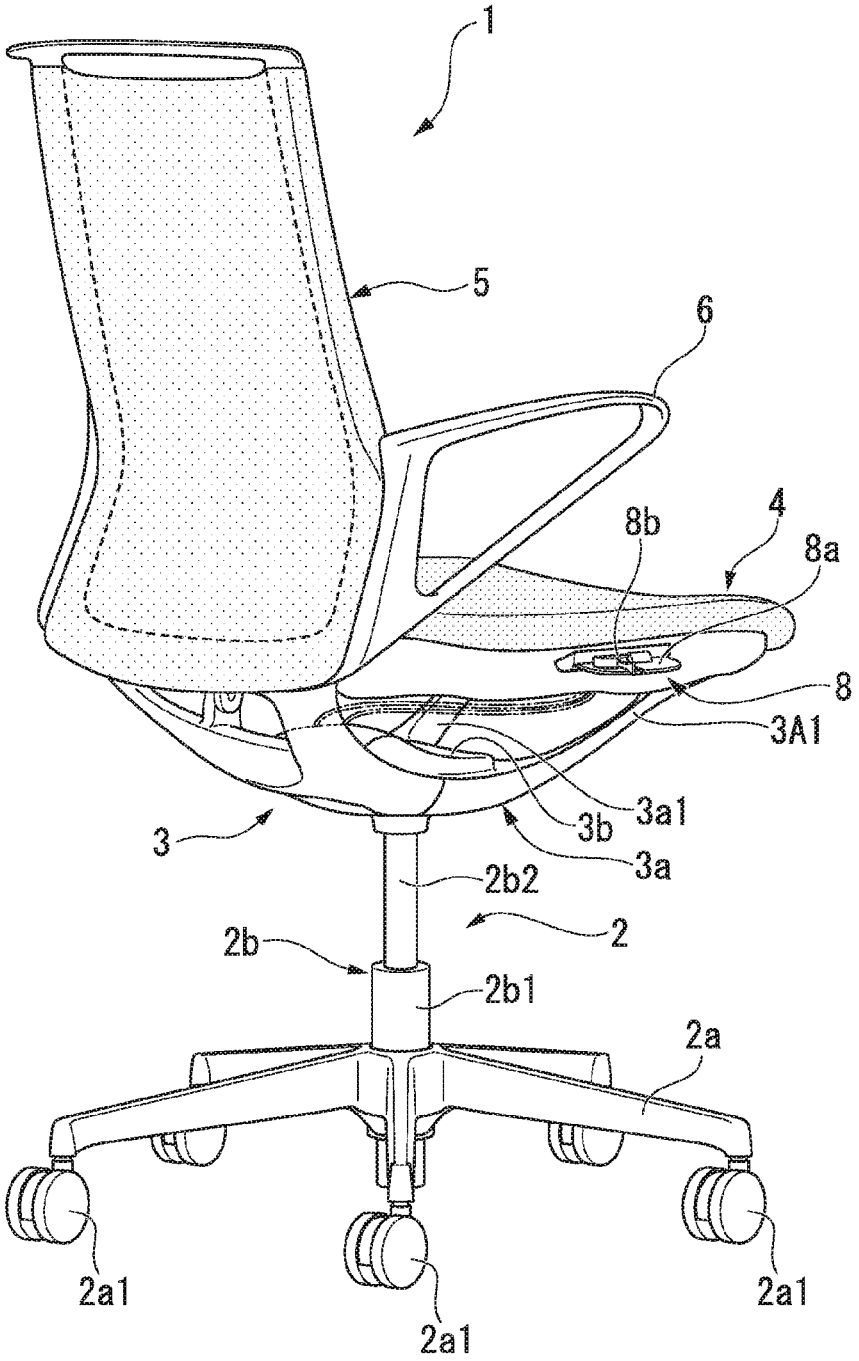
FIG. 2 is a perspective view of the chair according to the first embodiment of the present invention as seen from a rear surface side thereof.

FIG. 1 is a perspective view of a chair 1 according to a first embodiment of the present invention as seen from a front surface side thereof, and FIG. 2 is a perspective view of the chair 1 according to the first embodiment of the present invention as seen from a rear surface side thereof.

The chair 1 according to the embodiment includes a leg portion 2 which is placed on a placement surface such as a floor, a support base 3 which is installed at an upper end of the leg portion 2, a seat 4 which is attached to an upper portion of the support base 3 and supports a user's buttocks and thighs, a backrest 5 which is attached to the support base 3 and supports a user's back on a rear side of the seat 4 and an armrest 6 which is supported by the support base 3 via the backrest 5 and on which a distal end of a user's arm rests. Also, in the embodiment, the support base 3 constitutes a main part of a support structure in the chair 1.

The leg portion 2 includes multiple legs 2*a*, each of which has a caster 2*a*1 at a lower end thereof, and a leg post 2*b* which stands upright from a center of the multiple legs 2*a*. The leg post 2*b* is constituted by a gas spring which has an outer cylinder 2*b*1 and a rod 2*b*2 capable of advancing and retracting in the outer cylinder 2*b*1. An upper end of the rod 2*b*2 is coupled to the support base 3 in a state in which a part thereof is disposed in the support base 3. A push valve 2*b*3 (refer to FIG. 7) for supplying/discharging gas (air) in the gas spring is provided on the upper end of the rod 2*b*2. In the leg post 2*b*, when the push valve 2*b*3 is pressed, the rod 2*b*2 is allowed to move upward and downward in the outer cylinder 2*b*1, and when the pressing against the push valve 2*b*3 is released, the upward and downward movement of the rod 2*b*2 is locked. Therefore, the seat 4 and the backrest 5 supported by the leg post 2*b* via the support base 3 can be controlled to move upward and downward by pressing the push valve 2*b*3.

The support base 3 attached to the leg portion 2 supports the seat 4 from a lower side thereof and supports the backrest 5 to be tilted backward and downward. A detailed structure of the support base 3 will be described in detail later.

Figure 3:
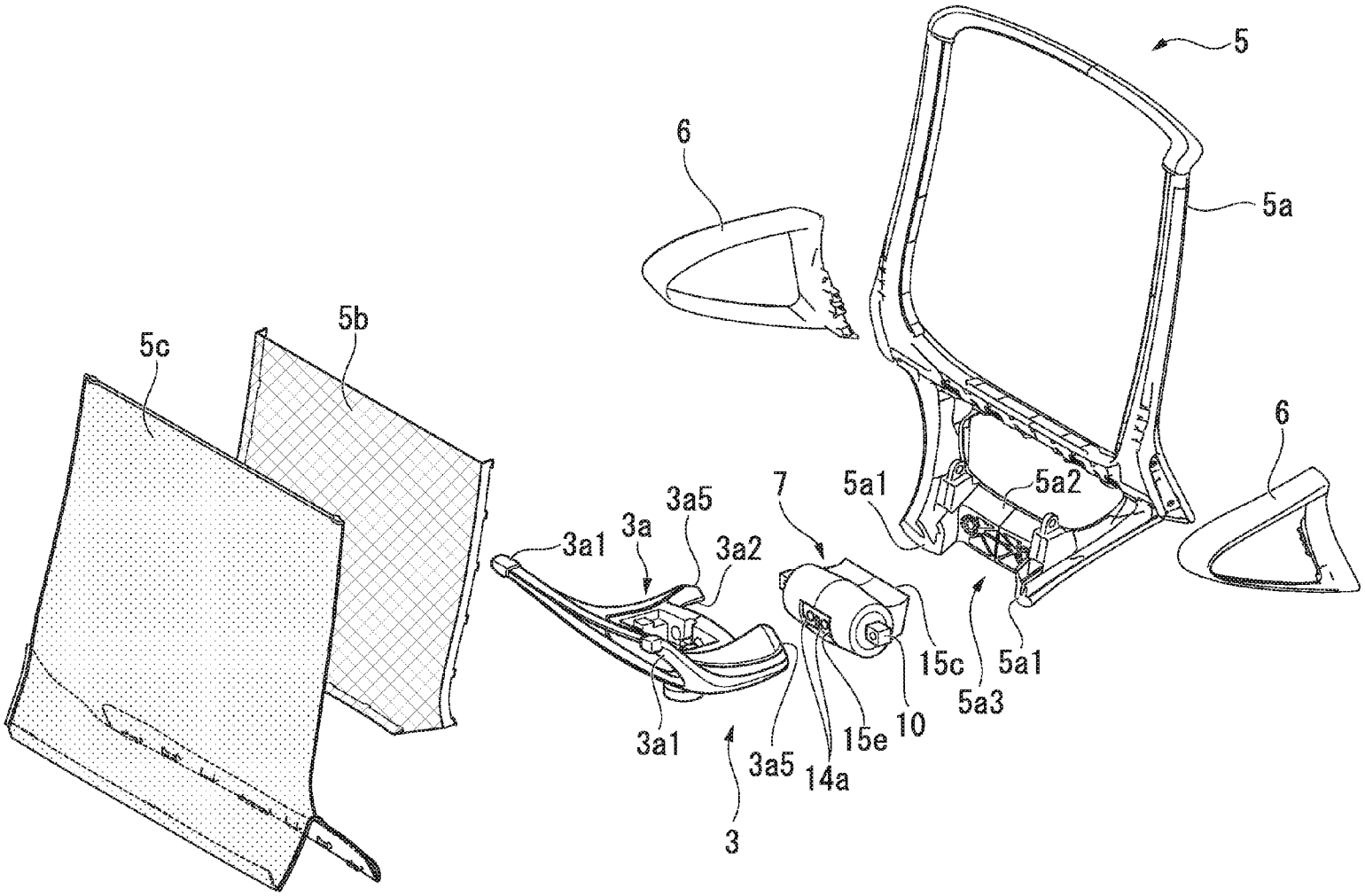
FIG. 3 is an exploded perspective view of a support base, a backrest and a torsion unit of the chair according to the first embodiment of the present invention as seen from a front side thereof.

FIG. 3 is a view showing a state in which a connection portion between the support base 3 and the backrest 5 is disassembled.

As shown in the drawing, the backrest 5 includes a frame 5*a* which is a strength member having a load receiving portion in the form of a rectangular frame, a first upholstery 5*b* which is stretched on the frame 5*a* to adjacent an opening of the load receiving portion of the frame 5*a*, and a second upholstery 5*c* which covers an outer side of the first upholstery 5*b*.

The frame 5*a* of the backrest 5 includes a pair of left and right forward rods 5*a*1 which extend from a lower end of the load receiving portion toward the support base 3, and a connecting portion 5*a*2 which connects the left and right forward rods 5*a*1 and to which a connection portion 15*c* of a torsion unit 7 to be described later is connected. Further, the armrest 6 is fixed to an outer side surface of each of left and right lower edges of the frame 5*a* of the backrest 5.

Also, the torsion unit 7 is provided at a connection portion between the support base 3 and the backrest 5 and applies a predetermined reaction force to the backrest 5 in a direction of an initial position thereof when the backrest 5 is tilted backward and downward with respect to the support base 3. Further, the torsion unit 7 can adjust the reaction force applied to the backrest 5 in two strong and weak stages and can lock rotation of the backrest 5 at the initial position. The torsion unit 7 constitutes the reaction force mechanism according to the embodiment.

Next, a detailed structure of the support base 3 and the torsion unit 7 will be described.

Figure 4:
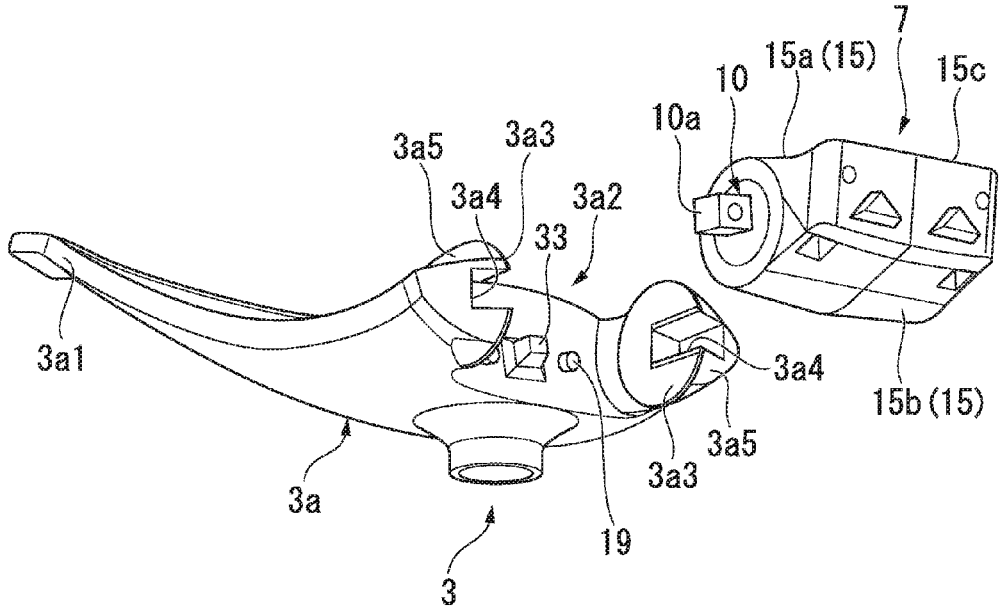
FIG. 4 is an exploded perspective view of a part of the support base and the torsion unit of the chair according to the first embodiment of the present invention as seen from a rear side thereof.
Figure 5:
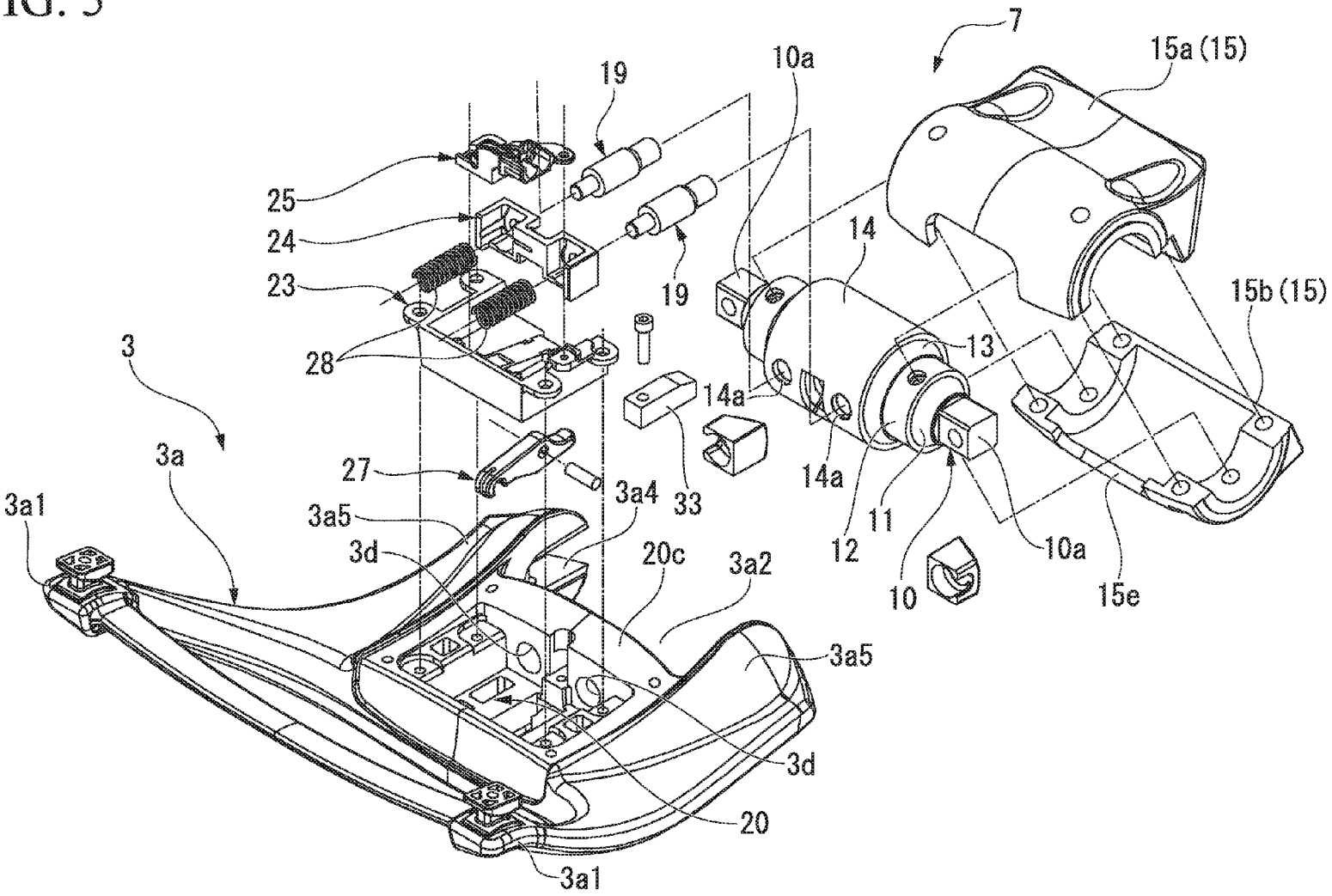
FIG. 5 is an exploded perspective view of the support base and the torsion unit of the chair according to the first embodiment of the present invention as seen from a front side thereof.
Figure 6:
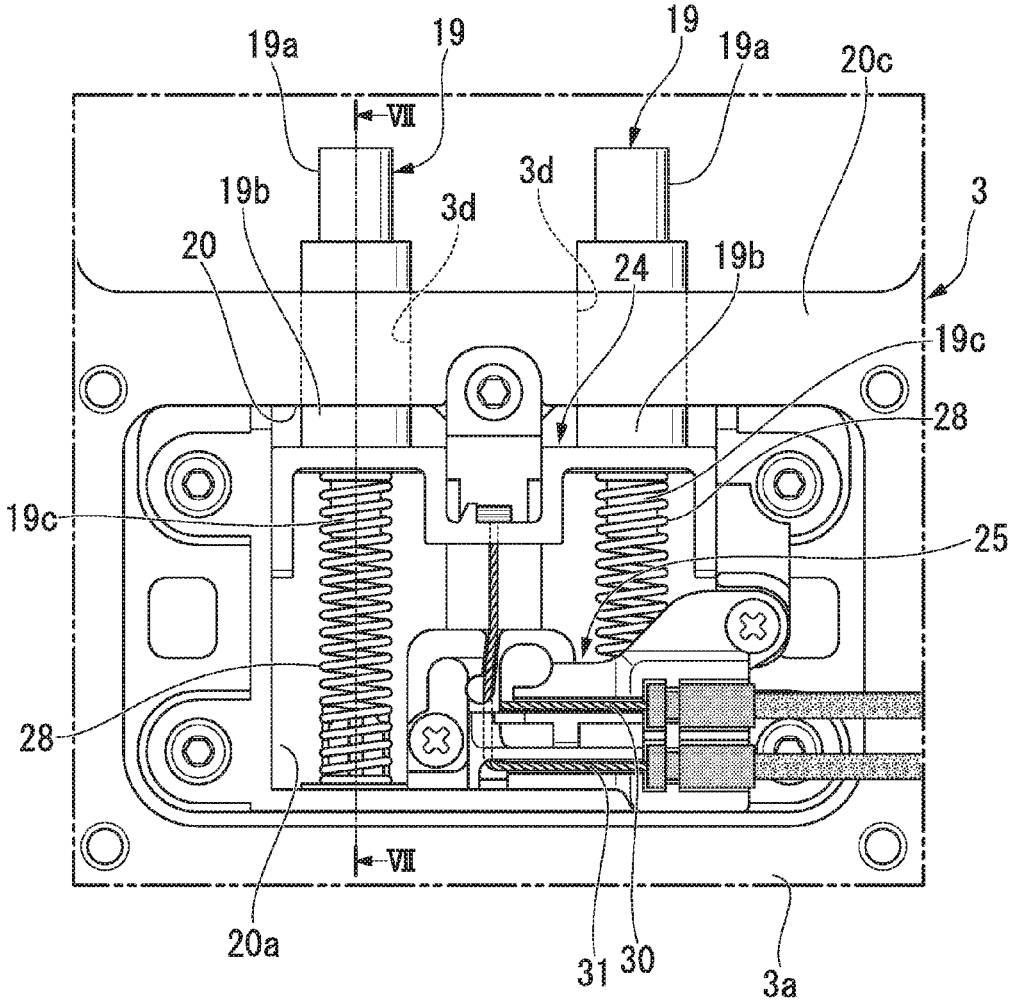
FIG. 6 is a plan view of the support base of the chair according to the first embodiment of the present invention.

FIG. 4 is an exploded perspective view of a part of the support base 3 and the torsion unit 7 as seen from a lower side of a rear portion thereof, and FIG. 5 is an exploded perspective view of the support base 3 and the torsion unit 7 as seen from an upper side of a front portion thereof. Also, FIG. 6 is a view of a central region on an upper surface side of the support base 3, FIG. 7 is a cross-sectional view of the support base 3 and the torsion unit 7 corresponding to a cross section along VII-VII of FIG. 6, and FIG. 8 is a cross-sectional view of the support base 3 and the torsion unit 7 corresponding to a cross section along VIII-VIII of FIG. 7.

The support base 3 has a base member 3*a* which is a strength member fixed to an upper end portion of the rod 2*b*2 of the leg post 2*b*. In the base member 3*a*, an accommodation recess portion 20 which has an approximately rectangular shape in a plane view is provided in a central region of an upper surface thereof, and a pair of backward rods 3*a*5 which extend backward and a pair of arms 3*a*1 which extend toward a front upper side thereof are provided on left and right side walls forming the accommodation recess portion 20. The pair of backward rods 3*a*5 form a recess portion 3*a*2 recessed forward in a concave shape between the backward rods 3*a*5 and a main body of the base member 3*a* in which the accommodation recess portion 20 is formed.

An inside of the accommodation recess portion 20 of the base member 3*a* is partitioned into an upper accommodation chamber 20*a* and a lower accommodation chamber 20*b* by a partition member 23.

Figure 7:
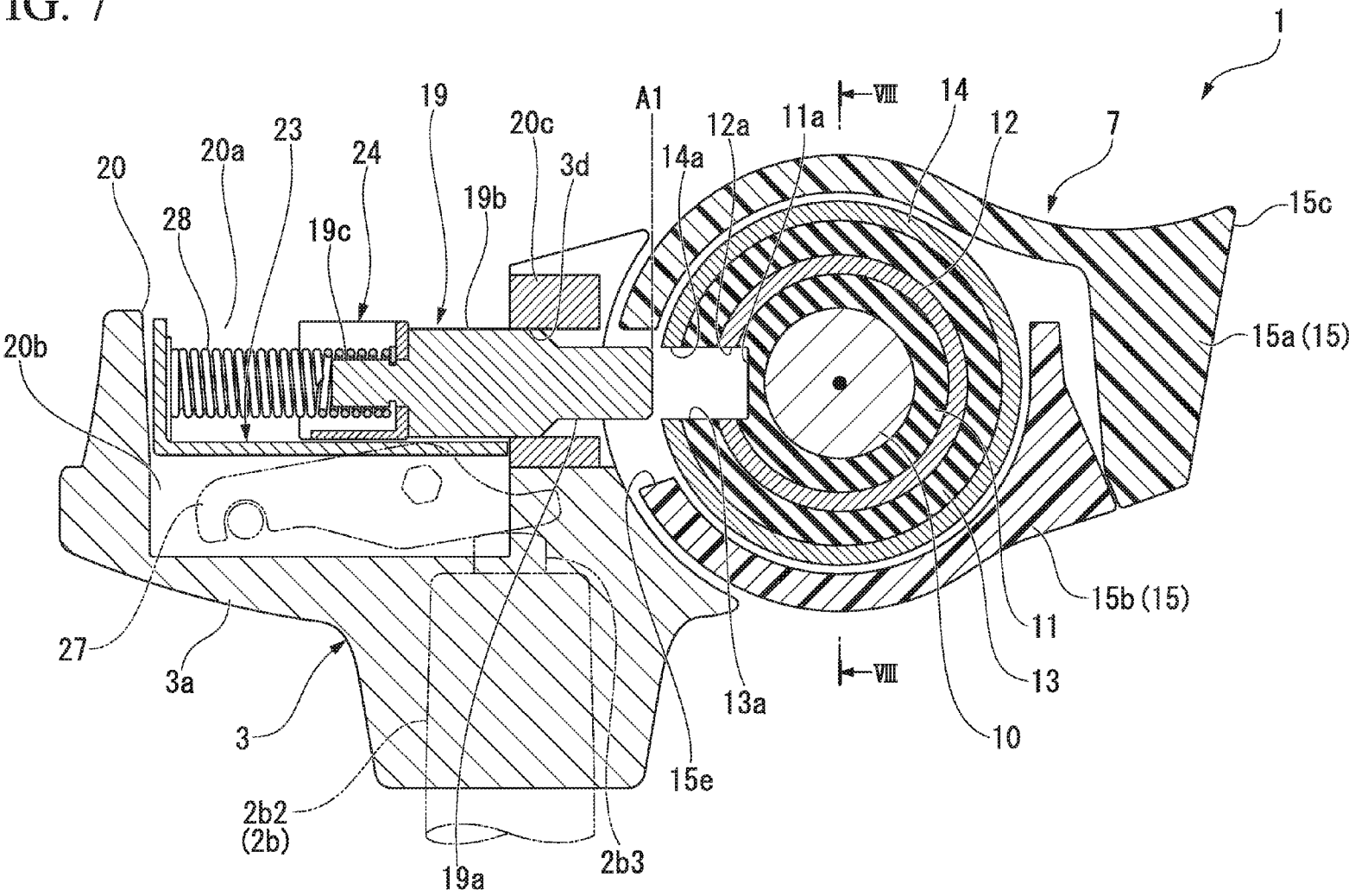
FIG. 7 is a cross-sectional view of the chair according to the first embodiment of the present invention corresponding to a cross section along VII-VII of FIG. 6.
Figure 8:
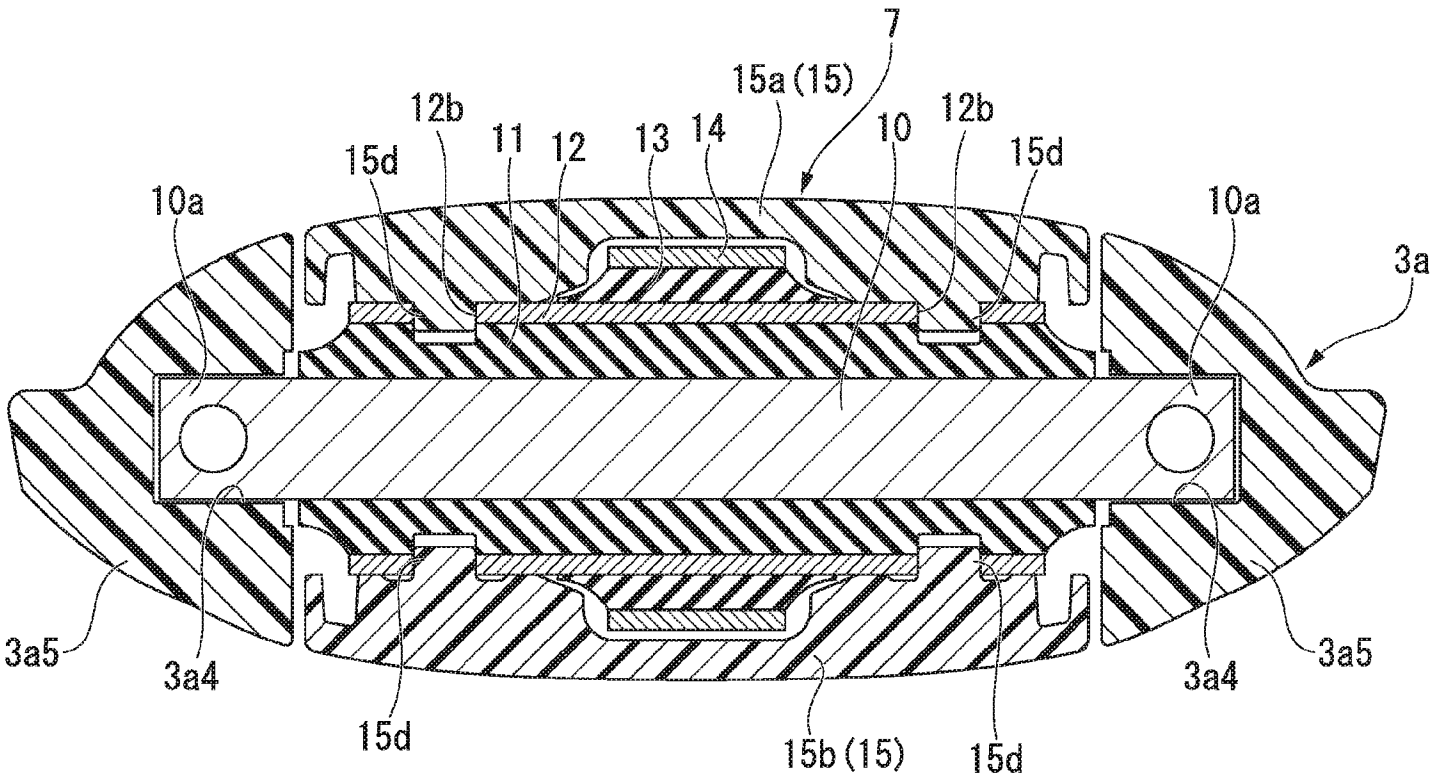
FIG. 8 is a cross-sectional view of the chair according to the first embodiment of the present invention corresponding to a cross section along VIII-VIII of FIG. 7.

The rod 2*b*2 of the leg post 2*b* is attached to a central portion of the base member 3*a*, and the upper end of the rod 2*b*2 including the push valve 2*b*3 protrudes into the lower accommodation chamber 20*b* of the accommodation recess portion 20 as shown in FIG. 7. A swing lever 27 for pressing the push valve 2*b*3 is pivotally supported on a lower surface side of the partition member 23. One end side of the swing lever 27 is connected to a lifting wire 30 (refer to FIG. 6), and the other end side thereof faces the push valve 2*b*3 to be capable of performing a pressing operation. The lifting wire 30 is drawn out from the partition member 23 to the upper accommodation chamber 20*a* side and is routed to an outside of the support base 3 via a wire guide 25. The lifting wire 30 drawn out from the support base 3 is connected to a lifting operation lever 8*a* (refer to FIG. 2) of an operation unit 8 provided on a right side portion of the seat 4. The lifting wire 30 is pulled by a pushing-up operation of the lifting operation lever 8*a* and thus rotates the swing lever 27 so that the push valve 2*b*3 is pressed.

A pair of holding holes 3*d* which pass through in a forward and backward direction are formed in a rear wall 20*c* of the accommodation recess portion 20 of the base member 3*a* to be spaced apart from each other in a left and right direction. An operation pin 19 which is elongated in an advancing and retracting direction is slidably fitted in each of the holding holes 3*d*. The operation pin 19 includes a large diameter portion 19*b* which is slidably fitted in the holding holes 3*d*, a small diameter portion 19*a* which protrudes from the large diameter portion 19*b* toward the torsion unit 7 side, and a locking portion 19*c* which protrudes from the large diameter portion 19*b* toward the inside of the accommodation recess portion 20. The operation pin 19 performs adjustment of the reaction force of the torsion unit 7 acting on the backrest 5 and tilt lock of the backrest 5 according to an advancing and retracting position in the forward and backward direction. In this embodiment, the operation pin 19 constitutes a reaction force adjusting part in the torsion unit 7 (reaction force mechanism).

Further, an interlocking member 24 to which each of the locking portions 19*c* of the left and right operation pins 19 is connected, and a pair of coil springs 28 which are disposed coaxially with the left and right operation pins 19 and are biasing parts for biasing the interlocking member 24 toward a rear side (the torsion unit 7 side) are accommodated in the upper accommodation chamber 20*a* of the accommodation recess portion 20. Therefore, the left and right operation pins 19 are biased toward the torsion unit 7 side by the coil spring 28 via the interlocking member 24. Further, a backrest operating wire 31 is connected to the interlocking member 24. The backrest operating wire 31 is routed to the outside of the support base 3 via the wire guide 25. The backrest operating wire 31 drawn out from the support base 3 is connected to a backrest operating lever 8*b* (refer to FIG. 2) of the operation unit 8 provided on a right side portion of the seat 4. The backrest operating wire 31 is pulled by a rotating operation of the backrest operating lever 8*b* and thus the left and right operation pins 19 are retracted against a biasing force of the coil springs 28. In the case of the embodiment, a rotational position of the backrest operating lever 8*b* can be changed to any of three positions. Therefore, the left and right operation pins 19 can be changed to any of the three positions in the forward and backward direction according to the rotational position of the backrest operating lever 8*b*.

Each distal end of the left and right arms 3*a*1 which extends toward a front upper side of the base member 3*a* is directly fixed to a lower surface of the seat 4. Further, the torsion unit 7 is accommodated in the recess portion 3*a*2 on a rear side of the base member 3*a*. A fitting groove 3*a*4 for fitting a pivot shaft 10 of the torsion unit 7 is provided in two facing inner side surfaces of the recess portion 3*a*2. Also, a separation distance between the backward rods 3*a*5 is set to be approximately equal to that between the above-described left and right forward rods 5*a*1 of the backrest 5.

Further, as shown in FIGS. 4 and 5, a restriction protrusion 33 is provided on a wall portion of the base member 3*a* which faces a rear side in the recess portion 3*a*2. The restriction protrusion 33 protrudes backward at an approximate intermediate position between the left and right operation pins 19. As will be described in detail later, the restriction protrusion 33 restricts a tilt range of the backrest 5 and applies an initial load to the torsion unit 7.

However, as shown in FIGS. 7 and 8, the torsion unit 7 includes the metal pivot shaft 10 which is a shaft member of an innermost layer, an inner cylinder 12 which is disposed radially outside the pivot shaft 10 to be adjacent thereto via a first rubber-like elastic member 11 (biasing member), an outer cylinder 14 which is disposed radially outside the inner cylinder 12 to be adjacent thereto via a second rubber-like elastic member 13 (biasing member), and a housing 15 which covers an outer side of the outer cylinder 14. Further, in the embodiment, the pivot shaft 10, the inner cylinder 12 and the outer cylinder 14 constitute a plurality of shaft members which are arranged approximately coaxially and radially in a multilayered manner.

The pivot shaft 10 is formed so that both axial ends 10*a* have a rectangular cross section, and both ends 10*a* protrude to an outside of the housing 15. The ends 10*a* of the pivot shaft 10 which protrude outward from the housing 15 are fitted and fixed in the fitting groove 3*a*4 provided in the recess portion 3*a*2 of the support base 3 in a state in which rotation thereof is restricted. Therefore, the pivot shaft 10 is fixed to prevent rotation relative to the base member 3*a* of the support base 3.

The inner cylinder 12 is formed of a rigid body such as a metal or a hard resin. The inner cylinder 12 is formed so that an axial length thereof is shorter than that of the housing 15. Therefore, the axial length of the inner cylinder 12 is set to be shorter than that of the pivot shaft 10.

The first rubber-like elastic member 11 is formed in an approximately cylindrical shape, and an inner circumferential surface and an outer circumferential surface thereof are vulcanization-bonded to an outer circumferential surface of the pivot shaft 10 and an inner circumferential surface of the inner cylinder 12. Both axial end surfaces of the first rubber-like elastic member 11 are inclined with respect to a direction orthogonal to the axial direction so that a radially inner side thereof expands outward in the axial direction.

Like the inner cylinder 12, the outer cylinder 14 is formed of a rigid body such as a metal or a hard resin. The outer cylinder 14 is formed so that an axial length thereof is sufficiently shorter than that of the inner cylinder 12. In the case of the embodiment, the axial length of the outer cylinder 14 is set to a length of about ⅓ of the axial length of the inner cylinder 12. The outer cylinder 14 is arranged in an approximate central region of the inner cylinder 12 in the axial direction.

The second rubber-like elastic member 13 is formed in an approximate cylindrical shape, and an inner circumferential surface and an outer circumferential surface thereof are vulcanization-bonded to an outer circumferential surface of the inner cylinder 12 and an inner circumferential surface of the outer cylinder 14. Both axial end surfaces of the second rubber-like elastic member 13 are inclined with respect to a direction orthogonal to the axial direction so that a radially inner side thereof expands outward in the axial direction.

Further, a lock hole 12*b* (refer to FIG. 8) for restricting relative rotation with respect to the housing 15 is provided in a region of a circumferential wall of the inner cylinder 12 which protrudes axially outward from the outer cylinder 14.

A fitting convex portion 15*d* which is fitted in the lock hole 12*b* is provided inside the housing 15.

The housing 15 has an upper member 15*a* and a lower member 15*b* which cover upper sides and lower sides of the outer cylinder 14 and the inner cylinder 12 from a radial outside of the pivot shaft 10. Additionally, the housing 15 is locked to prevent rotation relative to the inner cylinder 12 by fitting the fitting convex portion 15*d* into the lock hole 12*b* of the inner cylinder 12 as described above. However, the housing 15 is separated from the outer cylinder 14 with a predetermined gap.

Further, the connection portion 15*c* which expands backward is provided at a rear side of the housing 15. The connection portion 15*c* is connected to the backrest 5 by a bolt fastening method or the like. Therefore, the housing 15 and the inner cylinder 12 locked in the housing 15 are connected to prevent rotation relative to the backrest 5.

Furthermore, in the embodiment, the pivot shaft 10 constitutes a first shaft member connected to the support base 3 which is the support structure (supporting member), and the inner cylinder 12 constitutes a second shaft member connected to the backrest 5 (supported member). Also, the outer cylinder 14 constitutes a third shaft member which is a shaft member other than the first shaft member and the second shaft member.

In addition, the restriction protrusion 33 which protrudes backward from the support base 3, and an opening 15*e* (refer to FIGS. 3, 5, and 7) which allows the pair of operation pins 19 to enter the housing 15 is formed on a front side wall of the housing 15. At a most retracted position (displaced in the forward direction) of the operation pin 19 shown in FIG. 7, a distal end of the small diameter portion 19*a* is disposed in the opening 15*e*. The opening 15*e* of the housing 15 is formed to have a vertical width which may prevent interference with the operation pin 19 within the tilt range of the backrest 5.

Figure 9:
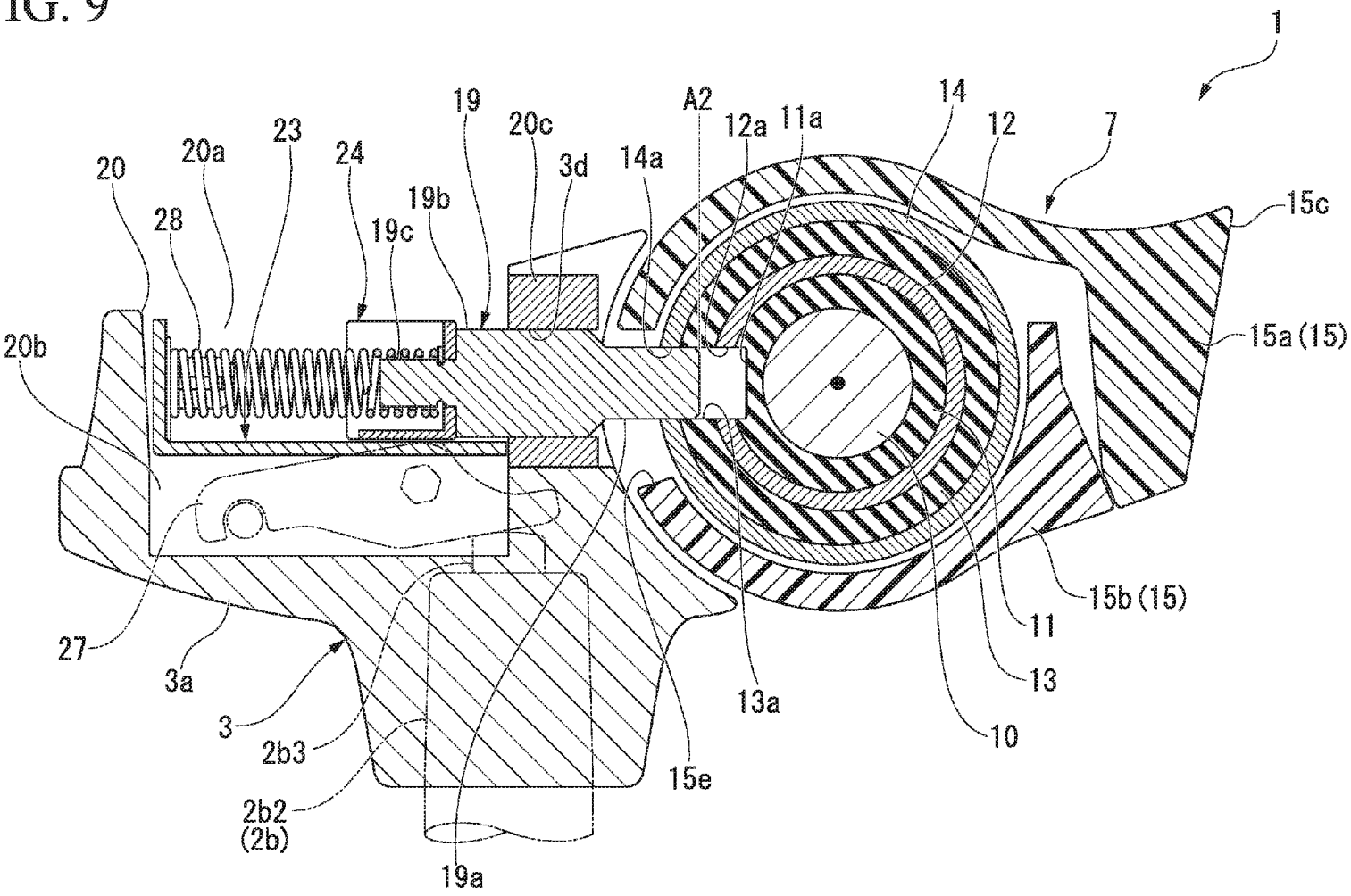
FIG. 9 is a cross-sectional view of the chair according to the first embodiment of the present invention corresponding to the cross section along VII-VII of FIG. 6.

Here, a pair of fitting holes 14*a* are formed in the outer cylinder 14 of the torsion unit 7 to be spaced apart from each other in the left and right direction. In each of the fitting holes 14*a*, the small diameter portions 19*a* of the left and right operation pins 19 held on the support base 3 side may be fitted in the axial direction. When the operation pins 19 are fitted in the fitting holes 14*a*, relative rotation of the outer cylinder 14 with respect to the support base 3 is locked. FIG. 9 is a cross-sectional view which is the same as that of FIG. 7 and shows a state in which the small diameter portions 19*a* of the operation pins 19 are fitted in only the fitting holes 14*a* of the outer cylinder 14.

A pair of fitting holes 12*a* are formed in the inner cylinder 12 of the torsion unit 7 to be spaced apart from each other in the left and right direction. The small diameter portions 19*a* of the operation pins 19 may be fitted in the fitting holes 12*a* in the axial direction. When the operation pins 19 are fitted in the fitting holes 12*a*, relative rotation of the inner cylinder 12 with respect to the support base 3 is locked.

Figure 10:
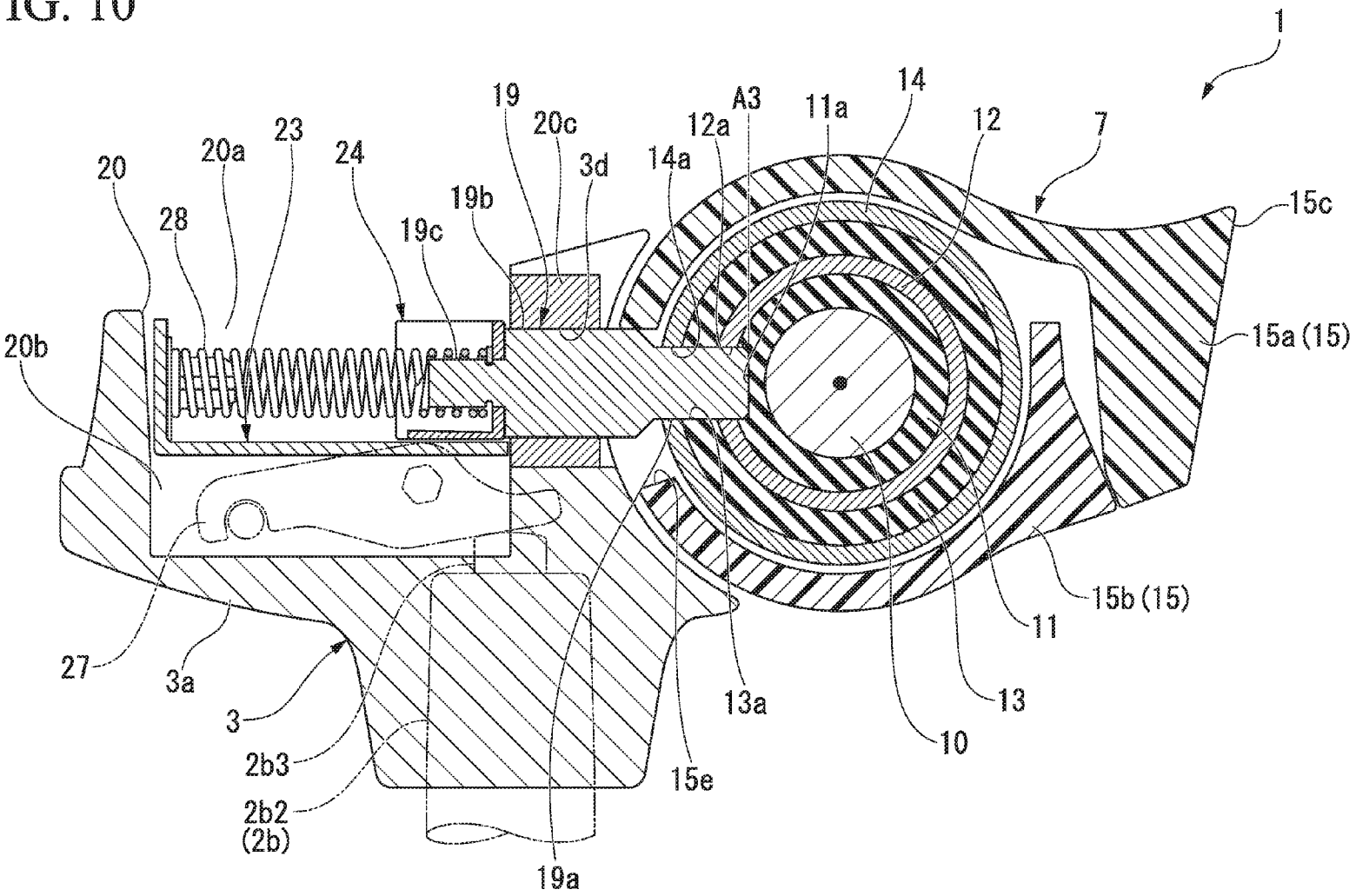
FIG. 10 is a cross-sectional view of the chair according to the first embodiment of the present invention corresponding to the cross section along VII-VII of FIG. 6.

Also, escape holes 13*a* and 11*a* for allowing advancing and retracting displacement of the operation pins 19 are provided in the second rubber-like elastic member 13 which connects the outer cylinder 14 and the inner cylinder 12 and the first rubber-like elastic member 11 which connects the inner cylinder 12 and the pivot shaft 10. The fitting hole 14*a* of the outer cylinder 14 and the fitting hole 12*a* of the inner cylinder 12 are set to be coaxial with each other when the backrest 5 is in an initial position (maximally standing initial rotating posture). Therefore, when the backrest 5 is in the initial position, the operation pins 19 can be fitted into the fitting holes 14*a* on the outer cylinder 14 side and the fitting holes 12*a* on the inner cylinder 12 side. FIG. 10 is a cross-sectional view which is the same as that of FIG. 7 and shows a state in which the small diameter portions 19*a* of the operation pins 19 are fitted in the fitting holes 14*a* of the outer cylinder 14 and the fitting holes 12*a* of the inner cylinder 12.

Here, the restriction protrusion 33 which protrudes from the support base 3 is arranged in the opening 15*e* of the housing 15 of the torsion unit 7 and restricts the tilt range of the backrest 5 integrally formed with the housing 15 by coming in contact with an upper side surface or a lower side surface of the opening 15*e*.

Further, when the torsion unit 7 is assembled to the support base 3, both ends 10*a* of the pivot shaft 10 are fitted in the corresponding fitting groove 3*a*4 on the support base 3 side to prevent relative rotation, as described above. Then, the housing 15 integrally formed with the inner cylinder 12 is rotated in a direction in which the backrest 5 is inclined backwards to twist the first rubber-like elastic member 11 by a predetermined amount, and in this state, the restriction protrusion 33 on the support base 3 side is fitted into the opening 15*e* of the housing 15. Accordingly, the upper side surface of the opening 15*e* of the housing 15 receives the reaction force of the first rubber-like elastic member 11 and comes in contact with an upper surface of the restriction protrusion 33. Therefore, when the torsion unit 7 is assembled in this way, the rotation of the backrest 5 is restricted in the initial position (initial posture) while the first rubber-like elastic member 11 is twisted and thus the initial reaction force is stored.

The left and right operation pins 19 held by the support base 3 may be changed to the three positions in the forward and backward direction according to the rotational position of the backrest operating lever 8*b* as described above, but the three positions are the following positions.

(1) First Biasing Force Adjustment Position A1

This is a most retracted position (refer to FIG. 7) in which the operation pins 19 are not engaged (fitted) with either of the outer cylinder 14 which is the third shaft member and the inner cylinder 12 which is the second shaft member.

(2) Second Biasing Force Adjustment Position A2

This is an intermediate advancing and retracting position (refer to FIG. 9) in which the operation pins 19 are engaged (fitted) only with the outer cylinder 14 which is the third shaft member.

(3) Lock Position A3

This is a most advanced position (refer to FIG. 10) in which the operation pins 19 are engaged (fitted) not only with the outer cylinder 14 which is the third shaft member but also with the inner cylinder 12 which is the second shaft member.

Next, adjustment of a tilt reaction force of the backrest 5 and tilt lock of the backrest 5 of the chair 1 according to the embodiment will be described.

To set the tilt reaction force of the backrest 5 to "weak," a user grips the backrest operating lever 8*b* of the operation unit 8 and rotates the backrest operating lever 8*b* to a "weak" position. At this time, the backrest operating wire 31 is maximally retracted, and the operation pins 19 supported by the support base 3 advance or retract to the first biasing force adjustment position A1 shown in FIG. 7. At this time, since the operation pins 19 are not engaged with either of the outer cylinder 14 and the inner cylinder 12, the rotation of the outer cylinder 14 becomes free without being restricted by the support base 3 side.

In this state, when the user leans on the backrest 5 and the backrest 5 is tilted backward and downward, the inner cylinder 12 integrally formed with the backrest 5 rotates relative to the pivot shaft 10 integrally formed with the support base 3, the first rubber-like elastic member 11 interposed between the pivot shaft 10 and the inner cylinder 12 is twisted, and the first rubber-like elastic member 11 generates the reaction force at this time. At this point, since the outer cylinder 14 rotates following the rotation of the inner cylinder 12, the second rubber-like elastic member 13 interposed between the inner cylinder 12 and the outer cylinder 14 does not generate the reaction force. Therefore, at this time, only a base reaction force resulting from the first rubber-like elastic member 11 acts on the backrest 5.

Further, to set the tilt reaction force of the backrest 5 to "strong," the user grips the backrest operating lever 8*b* of the operation unit 8 and rotates the backrest operating lever 8*b* to a "strong" position. At this time, the backrest operating wire 31 is retracted relatively little, and the operation pins 19 supported by the support base 3 advance or retract to the second biasing force adjustment position A2 shown in FIG. 9. At this time, since the operation pins 19 are engaged with the outer cylinder 14, the rotation of the outer cylinder 14 is restricted by the support base 3.

In this state, when the user leans on the backrest 5 and the backrest 5 is tilted backward and downward, the inner cylinder 12 integrally formed with the backrest 5 rotates relative to the pivot shaft 10 integrally formed with the support base 3, and the first rubber-like elastic member 11 interposed between the pivot shaft 10 and the inner cylinder 12 is twisted. Also, at this point, since the rotation of the outer cylinder 14 is restricted by the support base 3, the second rubber-like elastic member 13 interposed between the inner cylinder 12 and the outer cylinder 14 is also twisted. As a result, both of the first rubber-like elastic member 11 and the second rubber-like elastic member 13 generate the reaction force, a reaction force resulting from the second rubber-like elastic member 13 is added to the base reaction force resulting from the first rubber-like elastic member 11, and thus the total reaction force acts on the backrest 5.

Meanwhile, to lock the tilt of the backrest, the user grips the backrest operating lever 8*b* of the operation unit 8 and rotates the backrest operating lever 8*b* to a "lock" position. At this time, the retracting of the backrest operating wire 31 is released, and the operation pins 19 supported by the support base 3 receive the biasing force of the coil springs 28 and advance or retract to the lock position A3 shown in FIG. 10. At this time, since the operation pins 19 are engaged with not only the outer cylinder 14 but also the inner cylinder 12, the rotation of the backrest 5 is locked by the operation pins 19.

As described above, in the torsion unit 7 (reaction force mechanism) of the chair 1 according to the embodiment, the pivot shaft 10, the inner cylinder 12 and the outer cylinder 14 are disposed approximately coaxially and radially in the multilayered manner. Also, since the first rubber-like elastic member 11 and the second rubber-like elastic member 13 respectively connect between the pivot shaft 10 and the inner cylinder 12 and between the inner cylinder 12 and the outer cylinder 14 and the rotation of the outer cylinder 14 which is not directly coupled to the support base 3 or the backrest 5 is restricted by the operation pins 19 which are the reaction force adjusting parts, the reaction force acting on the backrest 5 can be increased. That is, in the torsion unit 7 according to the embodiment, the rotation of the outer cylinder 14 is restricted by displacing the operation pins 19 from the first biasing force adjustment position A1 to the second biasing force adjustment position A2, and the reaction force resulting from the second rubber-like elastic member 13 is added to the base reaction force resulting from the first rubber-like elastic member 11, and thus the reaction force acting on the backrest 5 can be increased. Therefore, even when an axial space which can be secured by the torsion unit 7 is limited, the axial length of each of the first rubber-like elastic member 11, the inner cylinder 12, the second rubber-like elastic member 13 and the outer cylinder 14 can be sufficiently secured. Accordingly, the torsion unit 7 which can easily change the reaction force can be obtained without a high degree of design accuracy.

Also, particularly, in the torsion unit 7 according to the embodiment, the pivot shaft 10 which is the shaft member of the innermost layer is coupled to the support base 3, and the inner cylinder 12 which is arranged radially outside the pivot shaft 10 to be adjacent thereto is connected to the backrest 5. Further, the outer cylinder 14 is disposed radially outside the inner cylinder 12, and the operation pins 19 which are the reaction force adjusting parts advance and retract between the first biasing force adjustment position A1 and the second biasing force adjustment position A2. Therefore, the reaction force when the operation pins 19 are operated to the second biasing force adjustment position A2 ("strong" position) can be relatively easily set to a desired reaction force. That is, in the case of the embodiment, the total reaction force can be easily set by simply adding the reaction force resulting from the second rubber-like elastic member 13 to the reaction force resulting from the first rubber-like elastic member 11.

Also, in the torsion unit 7 according to the embodiment, the axial length of the inner cylinder 12 which is disposed radially inward is set to be longer than that of the outer cylinder 14 disposed radially outside, and both axial ends of the inner cylinder 12 protrude axially outward from the outer cylinder 14. Therefore, the inner cylinder 12 which is disposed inside the outer cylinder 14 can be easily positioned in the housing 15 or the like by using both axial protruding portions of the inner cylinder 12, for example, by providing the lock hole 12*b* engaged with the fitting convex portion 15*d*.

Also, in the torsion unit 7 according to the embodiment, the biasing members interposed between the pivot shaft 10 and the inner cylinder 12 and between the inner cylinder 12 and the outer cylinder 14 are constituted with the rubber-like elastic member (first rubber-like elastic member 11 and second rubber-like elastic member 13) which is vulcanization-bonded to each of the circumferential surfaces thereof. Therefore, when the relative rotation occurs between the pivot shaft 10 and the inner cylinder 12 or between the inner cylinder 12 and the outer cylinder 14, the rubber-like elastic member is twisted and deformed approximately evenly over an entire region thereof. Accordingly, the stable tilt reaction force can be obtained while the entire torsion unit 7 has a compact structure.

Further, in the case of the embodiment, the axial outer end surfaces of the first rubber-like elastic member 11 and the second rubber-like elastic member 13 are formed to be inclined axially outward with respect to a direction orthogonal to the axial direction, and thus a cross section of each of the rubber-like elastic members in the axial direction has an approximate trapezoidal shape. Therefore, axial misalignment of the shaft members disposed radially inside and outside each of the rubber-like elastic members can be efficiently restricted by the rubber-like elastic members. Accordingly, in the torsion unit 7 according to the embodiment, the stable reaction force can always be obtained.

Figure 11:
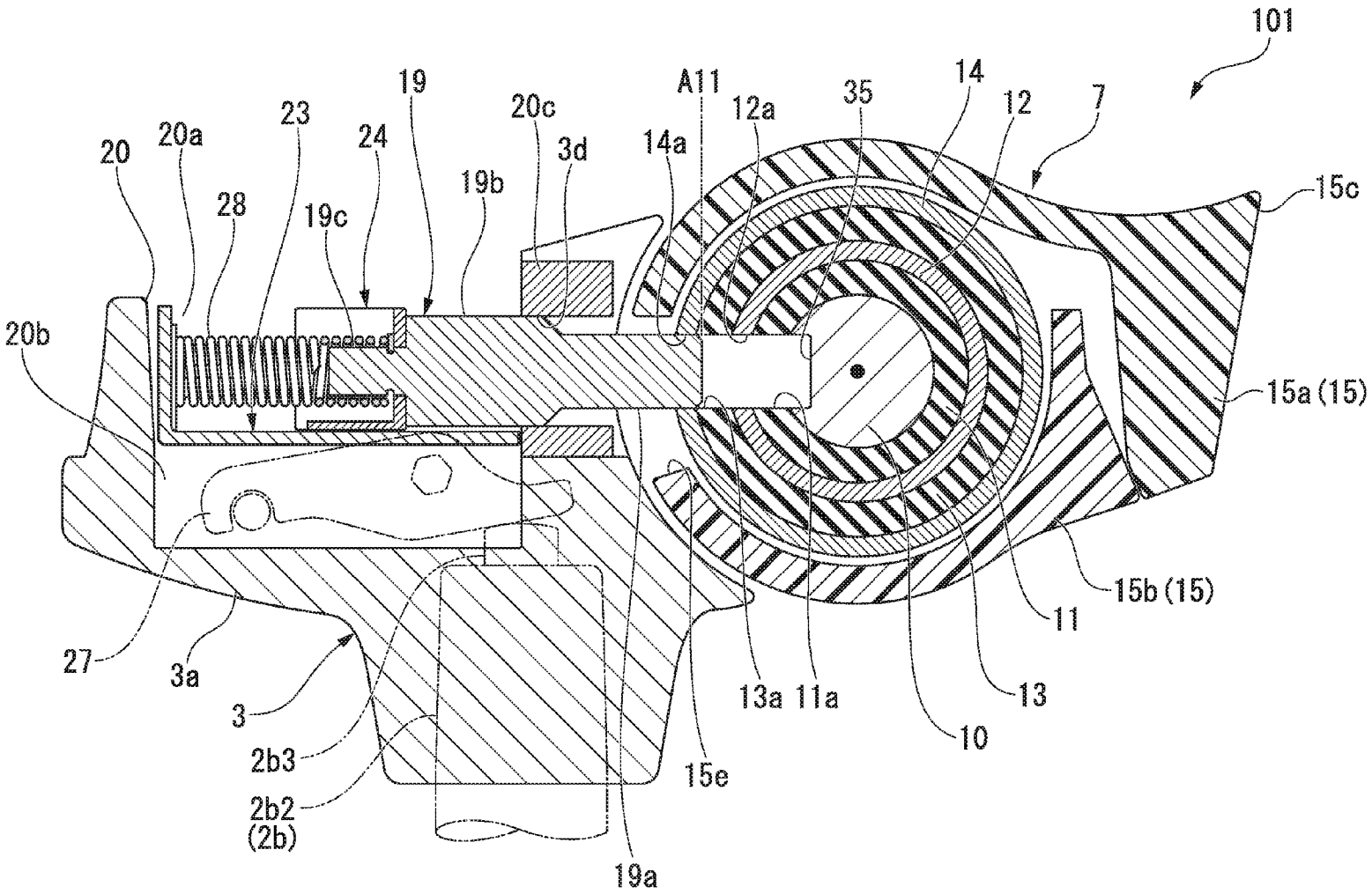
FIG. 11 is a cross-sectional view of a chair according to a second embodiment of the present invention corresponding to FIG. 7 of the chair of the first embodiment.
Figure 12:
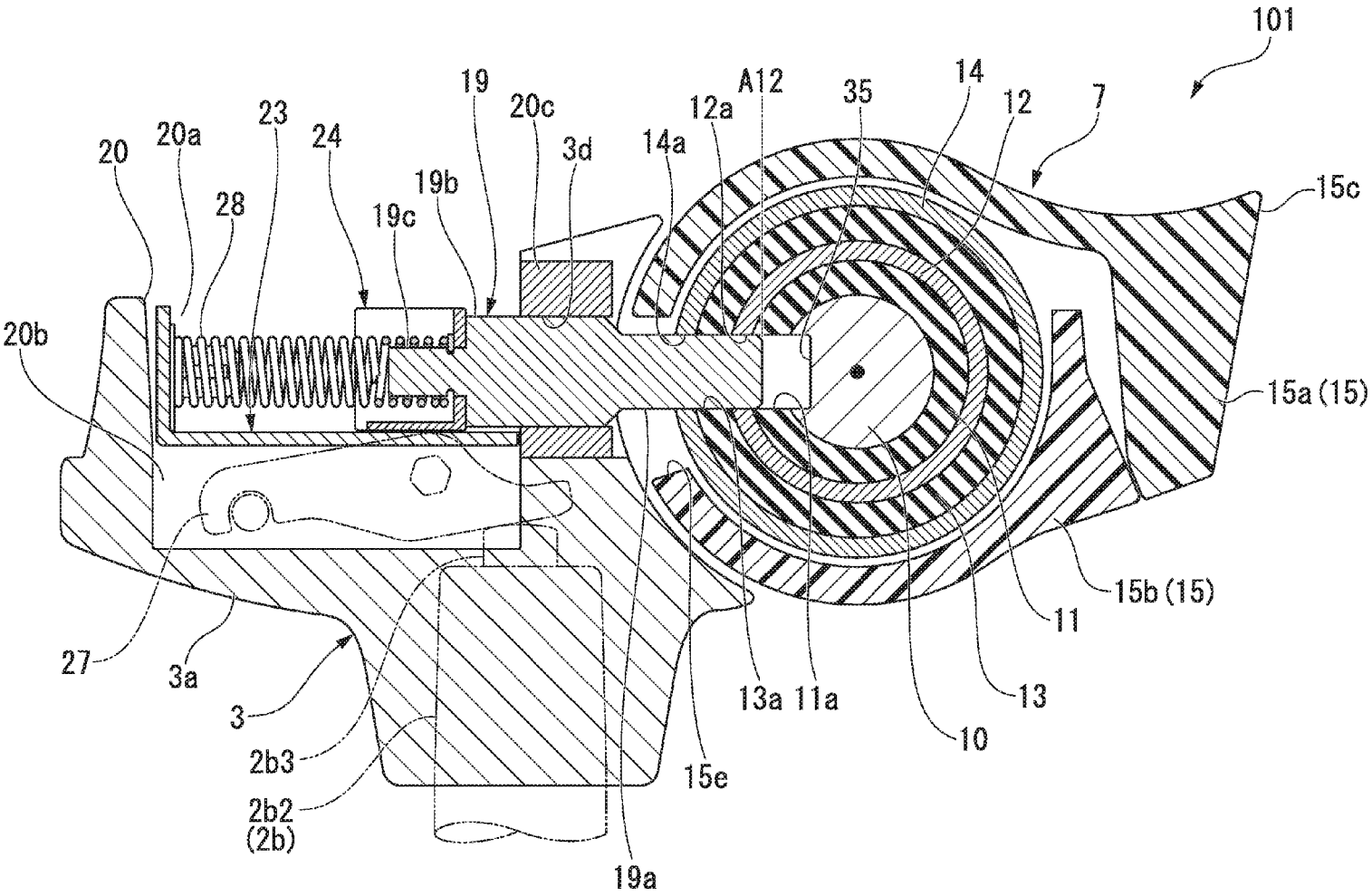
FIG. 12 is a cross-sectional view of the chair according to the second embodiment of the present invention corresponding to FIG. 9 of the chair of the first embodiment.
Figure 13:
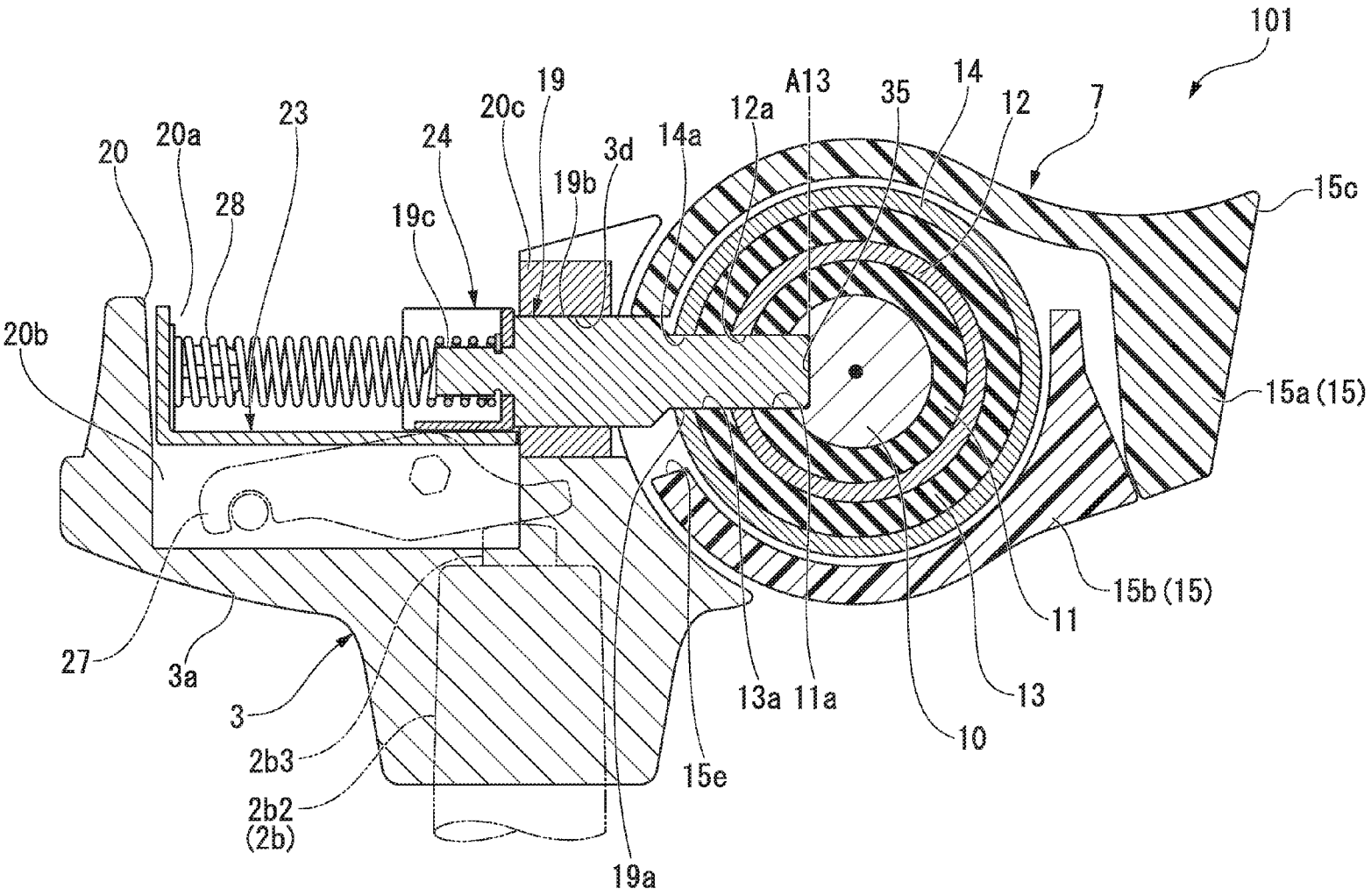
FIG. 13 is a cross-sectional view of the chair according to the second embodiment of the present invention corresponding to FIG. 10 of the chair of the first embodiment.

Next, a second embodiment shown in FIGS. 11 to 13 will be described. Also, FIG. 11 is a view corresponding to FIG. 7 of the first embodiment, FIG. 12 is a view corresponding to FIG. 9 of the first embodiment, and FIG. 13 is a view corresponding to FIG. 10 of the first embodiment.

In a chair 101 according to the second embodiment like in the first embodiment, a torsion unit 107 which is a reaction force mechanism includes a pivot shaft 10, an inner cylinder 12, an outer cylinder 14 and a housing 15, the pivot shaft 10 and the inner cylinder 12 are connected by a first rubber-like elastic member 11, and the inner cylinder 12 and the outer cylinder 14 are connected by a second rubber-like elastic member 13. However, the pivot shaft 10 is integrally coupled to a backrest (not shown), and the outer cylinder 14 is integrally coupled to a support base 3. Additionally, fitting holes 14*a* and 12*a* into which small diameter portions 19*a* of operation pins 19 can be fitted as reaction force adjusting parts are formed in the outer cylinder 14 and the inner cylinder 12, respectively, and a lock hole 35 into which a distal end of the small diameter portion 19*a* of the operation pin 19 can be fitted is formed in the pivot shaft 10. Further, the operation pin 19 is held in the support base 3 to be able to advance and retract, like in the first embodiment.

In the case of the embodiment, the outer cylinder 14 constitutes a first shaft member, the pivot shaft 10 constitutes a second shaft member, and the inner cylinder 12 constitutes a third shaft member.

The operation pin 19 is operated to advance and retract among a first biasing force adjustment position A11 (refer to FIG. 11) in which the operation pin is not engaged with either of the inner cylinder 12 and the pivot shaft, a second biasing force adjustment position A12 (refer to FIG. 12) in which the operation pins are fitted into the fitting hole 12*a* of the inner cylinder 12, and a lock position (refer to FIG. 13) in which the operation pins are fitted into the lock hole 35 of the pivot shaft 10.

When the tilt reaction force of the backrest is set to "weak," the operation pin 19 supported by the support base 3 is operated to advance and retract to the first biasing force adjustment position A11 shown in FIG. 11. At this time, since the operation pin 19 is not engaged with either of the inner cylinder 12 and the pivot shaft 10, the inner cylinder 12 rotates and is displaced following the pivot shaft 10 which is adjacent thereto via the first rubber-like elastic member 11 when the pivot shaft 10 rotates together with the backrest, and a base reaction force is generated in a state in which the first rubber-like elastic member 11 between the pivot shaft 10 and the inner cylinder 12 and the second rubber-like elastic member 13 between the inner cylinder 12 and the outer cylinder 14 are connected in series. Therefore, the reaction force generated at this time is relatively small compared with a case in which the first rubber-like elastic member 11 or the second rubber-like elastic member 13 is separately twisted and the reaction force is generated. As a result, a relatively small reaction force acts on the backrest 5.

When the tilt reaction force of the backrest is set to "strong," the operation pin 19 supported by the support base 3 is operated to advance and retract to the second biasing force adjustment position A12 shown in FIG. 12. At this time, since the operation pin 19 is engaged with the fitting hole 12*a* of the inner cylinder 12, the rotation of the inner cylinder 12 is locked by the operation pin 19. Therefore, at this time, when the pivot shaft 10 rotates together with the backrest, only the first rubber-like elastic member 11 between the pivot shaft 10 and the inner cylinder 12 is twisted and deformed, and a reaction force larger than the above-described base reaction force is generated. As a result, a relatively large reaction force acts on the backrest 5.

Further, when the tilt reaction force of the backrest is locked, the operation pin 19 supported by the support base 3 is operated to advance and retract to the lock position A13 shown in FIG. 13. At this time, since the operation pin 19 is engaged with not only the fitting hole 12*a* of the inner cylinder 12 but also the lock hole 35 of the pivot shaft 10, the rotation of the pivot shaft 10 is restricted by the operation pin 19. As a result, the tilt of the backrest is locked.

As described above, the torsion unit 107 used in the chair 101 according to the second embodiment generates the reaction force in a state in which the first rubber-like elastic member 11 and the second rubber-like elastic member 13 are connected in series when the operation pin 19 is in the first biasing force adjustment position A11. Additionally, when the operation pin 19 is operated from this state to the second biasing force adjustment position A12 and restricts the rotation of the inner cylinder 12, only the first rubber-like elastic member 11 generates a reaction force. Therefore, when the operation pin 19 is operated from the first biasing force adjustment position A11 to the second biasing force adjustment position A12, the reaction force acting on the backrest can be increased with respect to the base reaction force generated in a state in which the first rubber-like elastic member 11 and the second rubber-like elastic member 13 are in a series state.

Therefore, also in the torsion unit 107 according to the second embodiment, even when an axial space to be secured is limited, an axial length of each of the first rubber-like elastic member 11, the inner cylinder 12, the second rubber-like elastic member 13 and the outer cylinder 14 can be sufficiently secured. Therefore, the torsion unit 107 which can easily change the reaction force can be obtained without a high degree of design accuracy.

Figure 14:
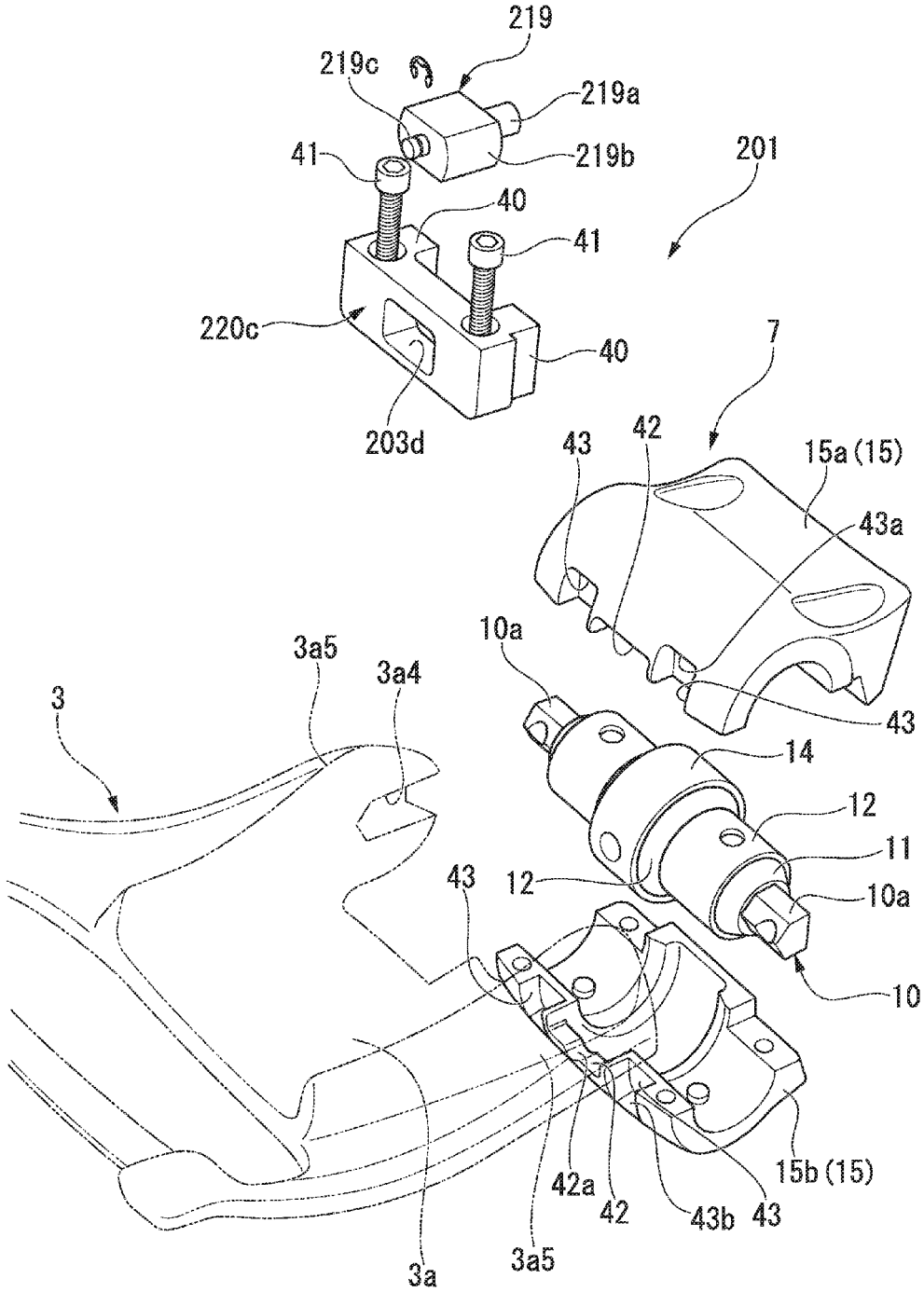
FIG. 14 is an exploded perspective view of a torsion unit and a part of a support base of a chair according to a third embodiment of the present invention as seen from a front side thereof.
Figure 15:
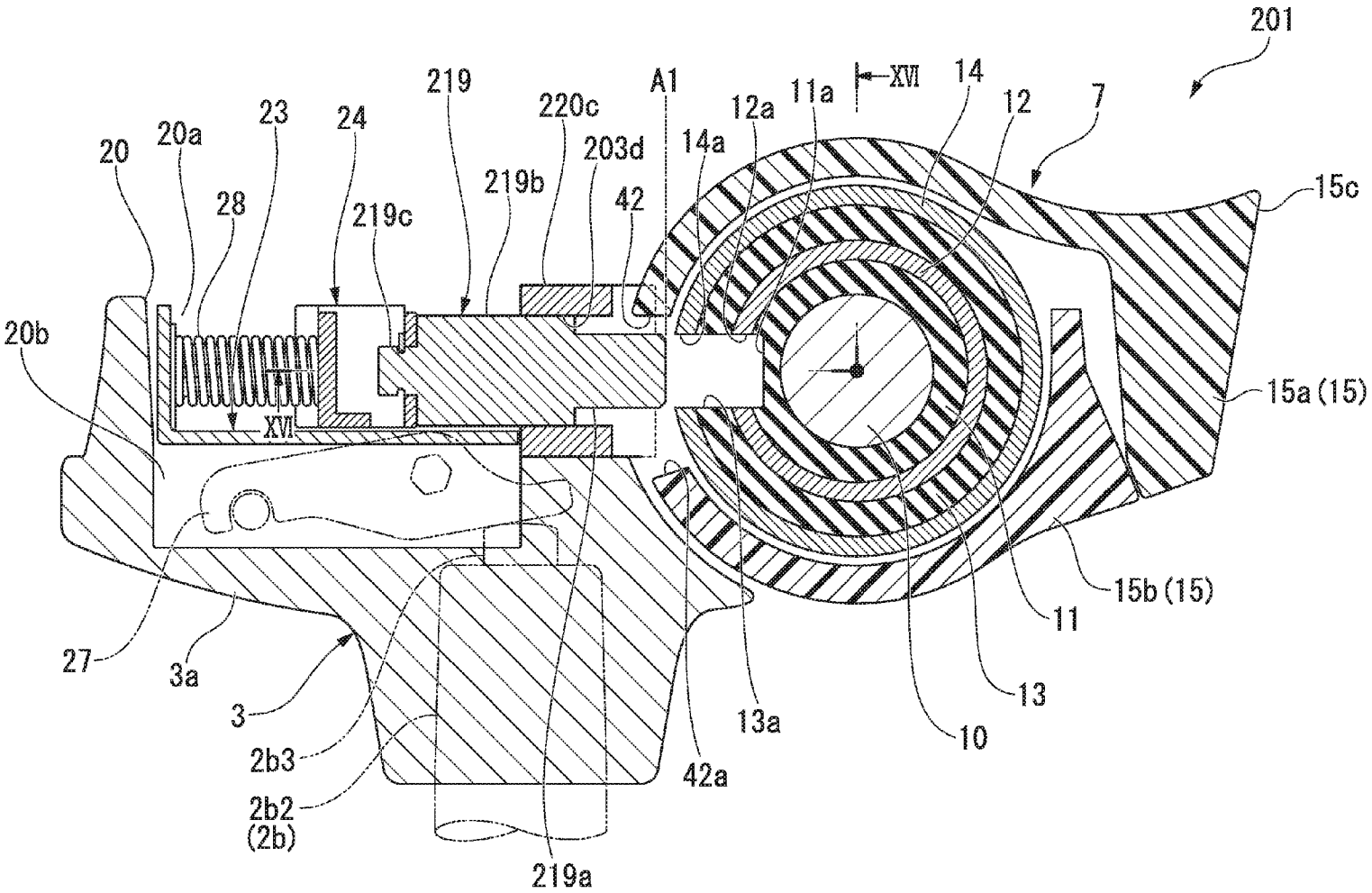
FIG. 15 is a cross-sectional view of the chair according to the third embodiment of the present invention corresponding to FIG. 7 of the chair of the first embodiment.
Figure 16:
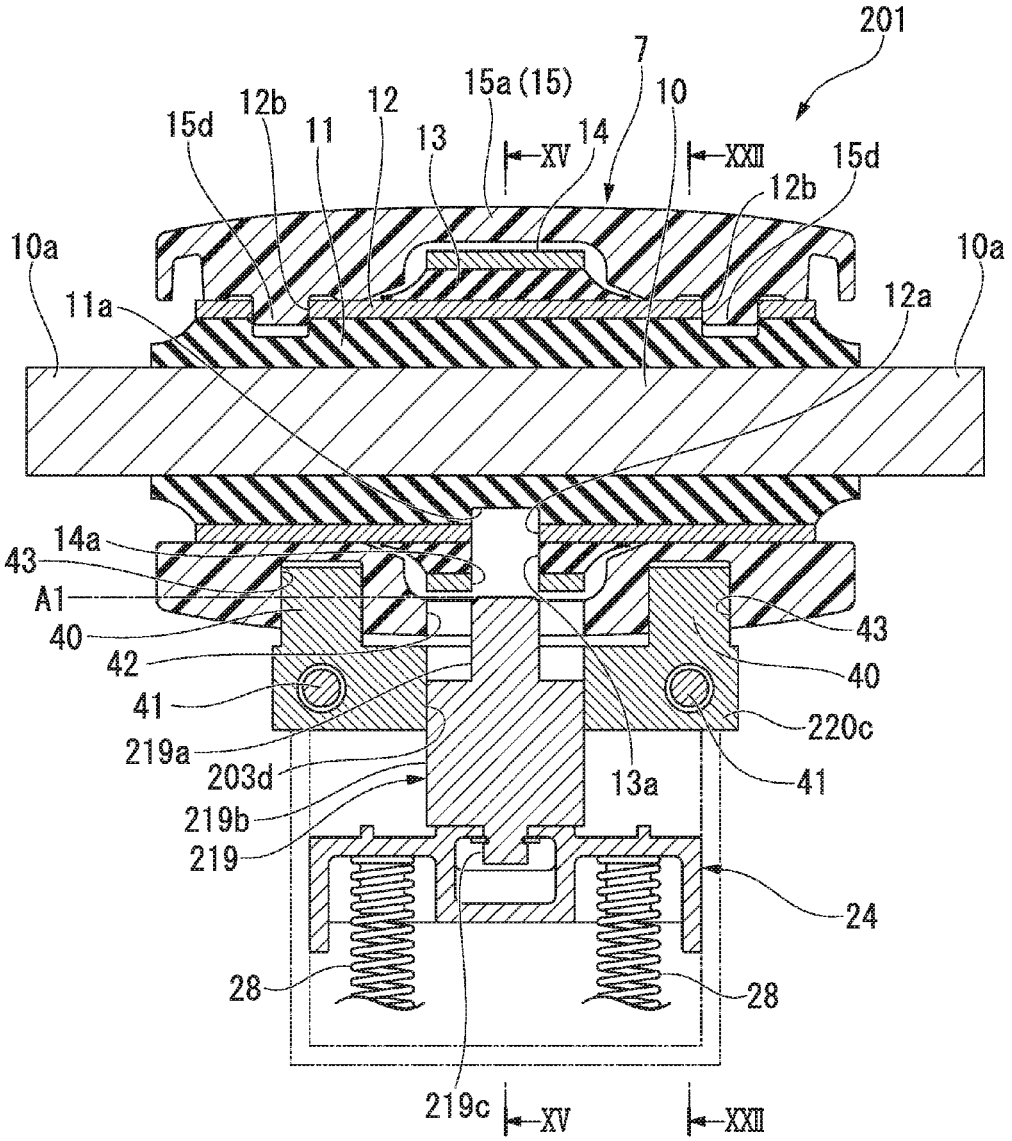
FIG. 16 is a cross-sectional view of the chair according to the third embodiment of the present invention corresponding to a cross section along XVI-XVI of FIG. 15.
Figure 17:
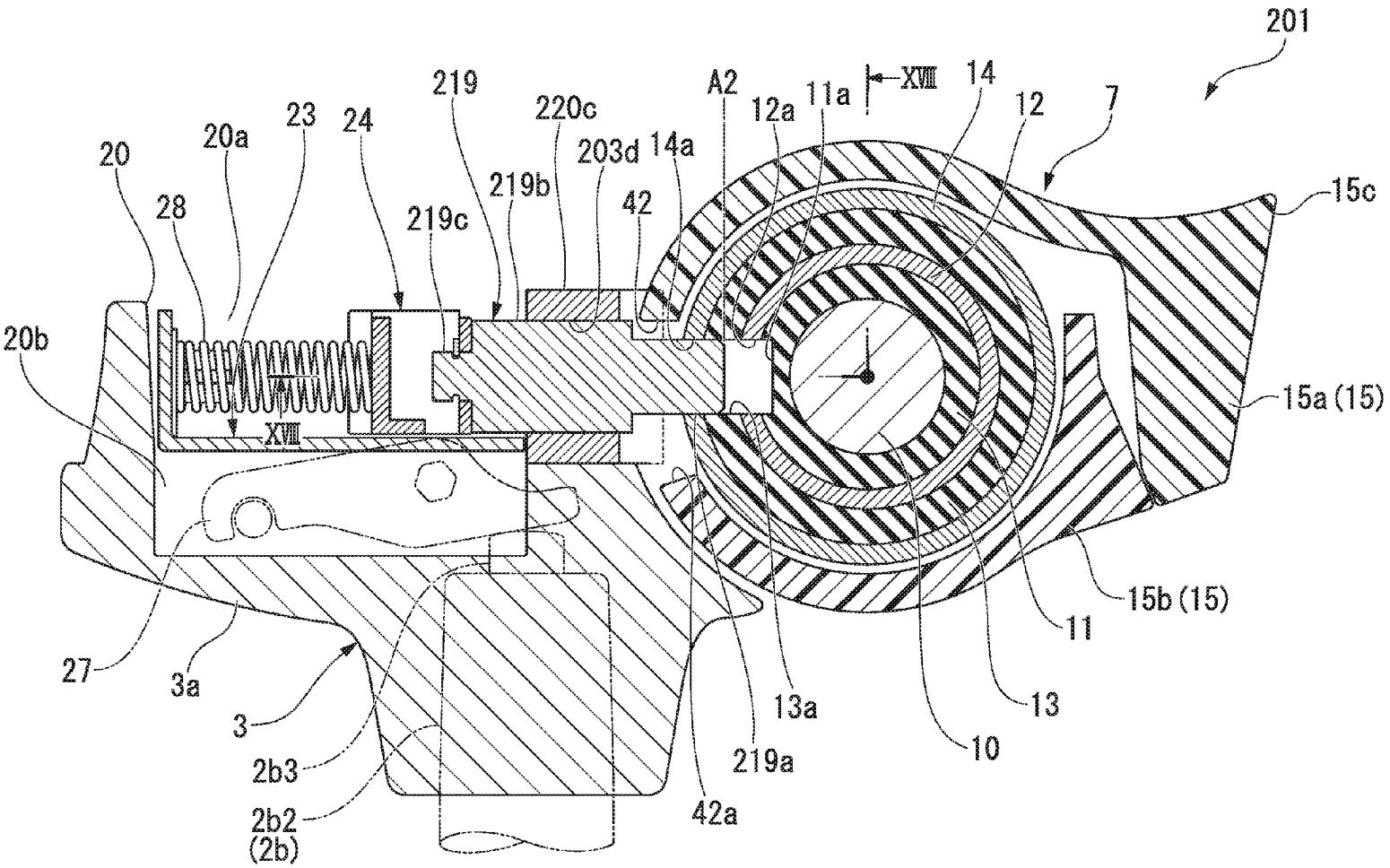
FIG. 17 is a cross-sectional view of the chair according to the third embodiment of the present invention corresponding to FIG. 9 of the chair of the first embodiment.
Figure 18:
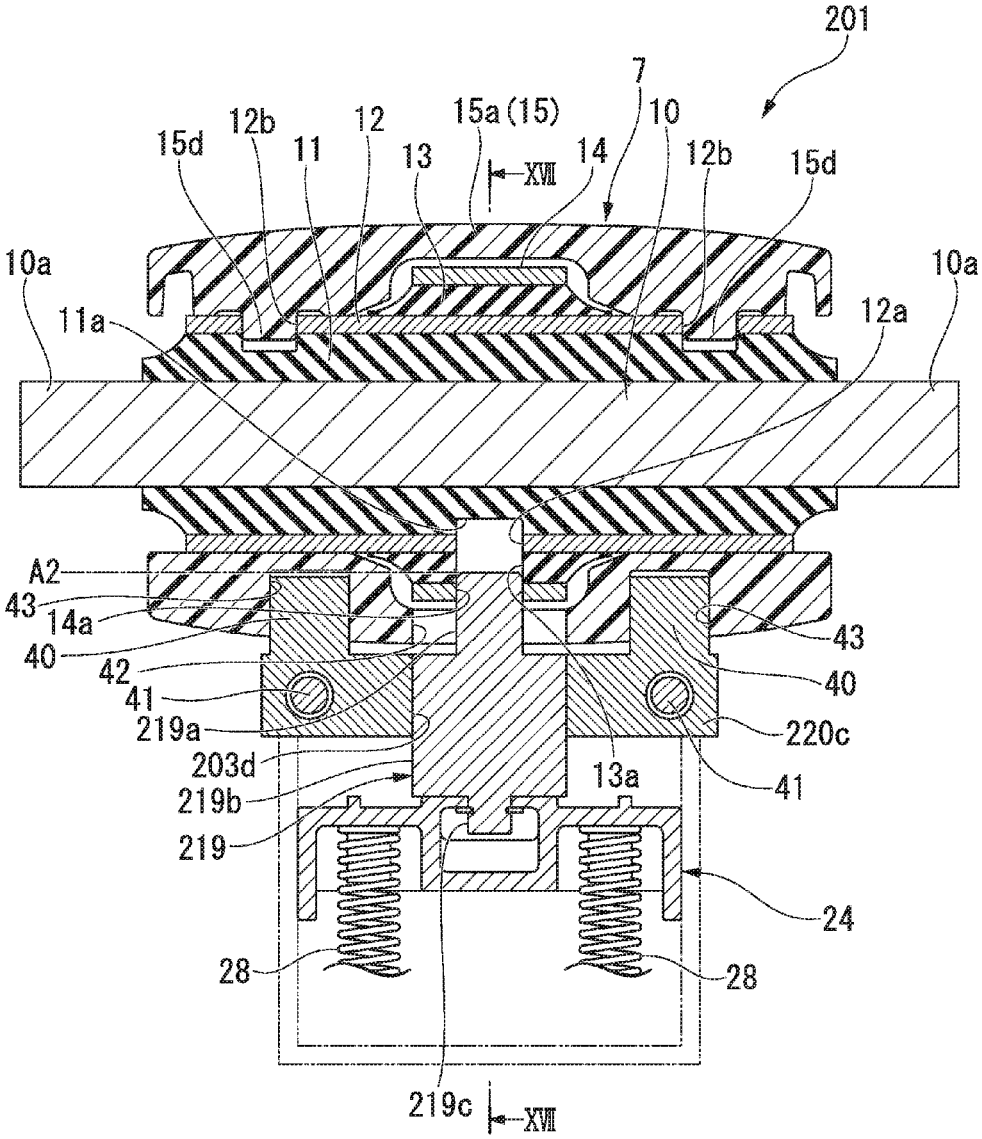
FIG. 18 is a cross-sectional view of the chair according to the third embodiment of the present invention corresponding to a cross section along XVIII-XVIII of FIG. 17.
Figure 19:
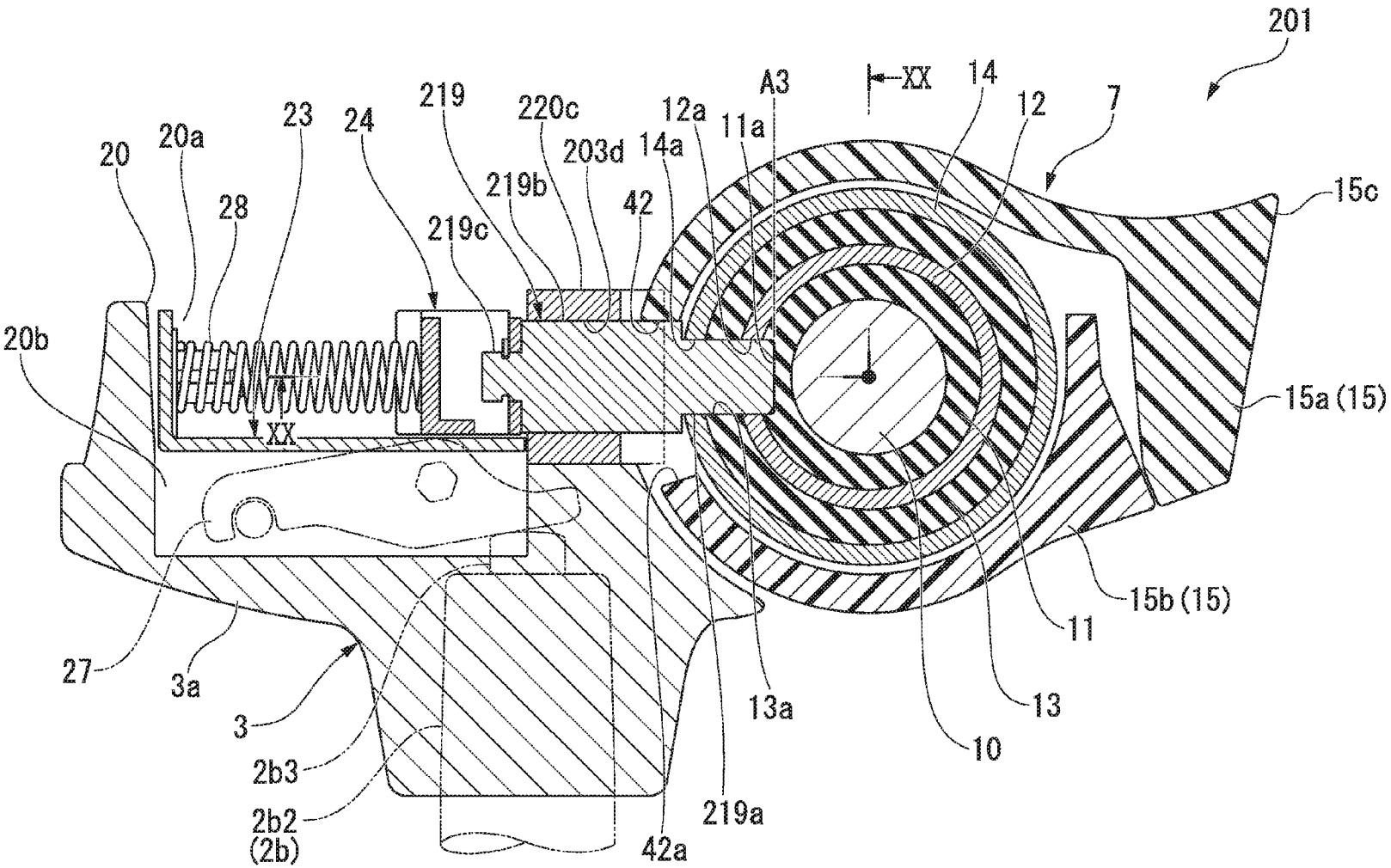
FIG. 19 is a cross-sectional view of the chair according to the third embodiment of the present invention corresponding to FIG. 10 of the chair of the first embodiment.
Figure 20:
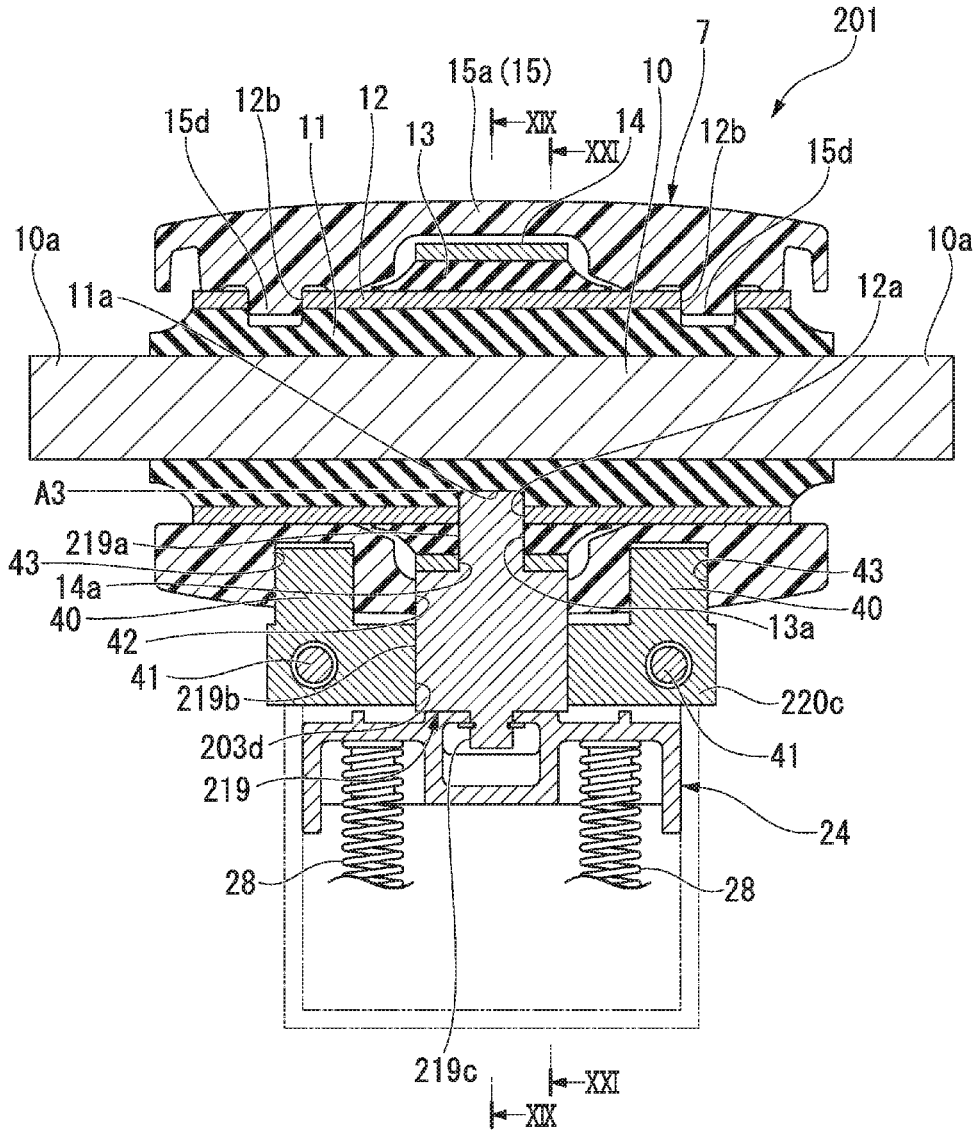
FIG. 20 is a cross-sectional view of the chair according to the third embodiment of the present invention corresponding to a cross section along XX-XX of FIG. 19.
Figure 21:
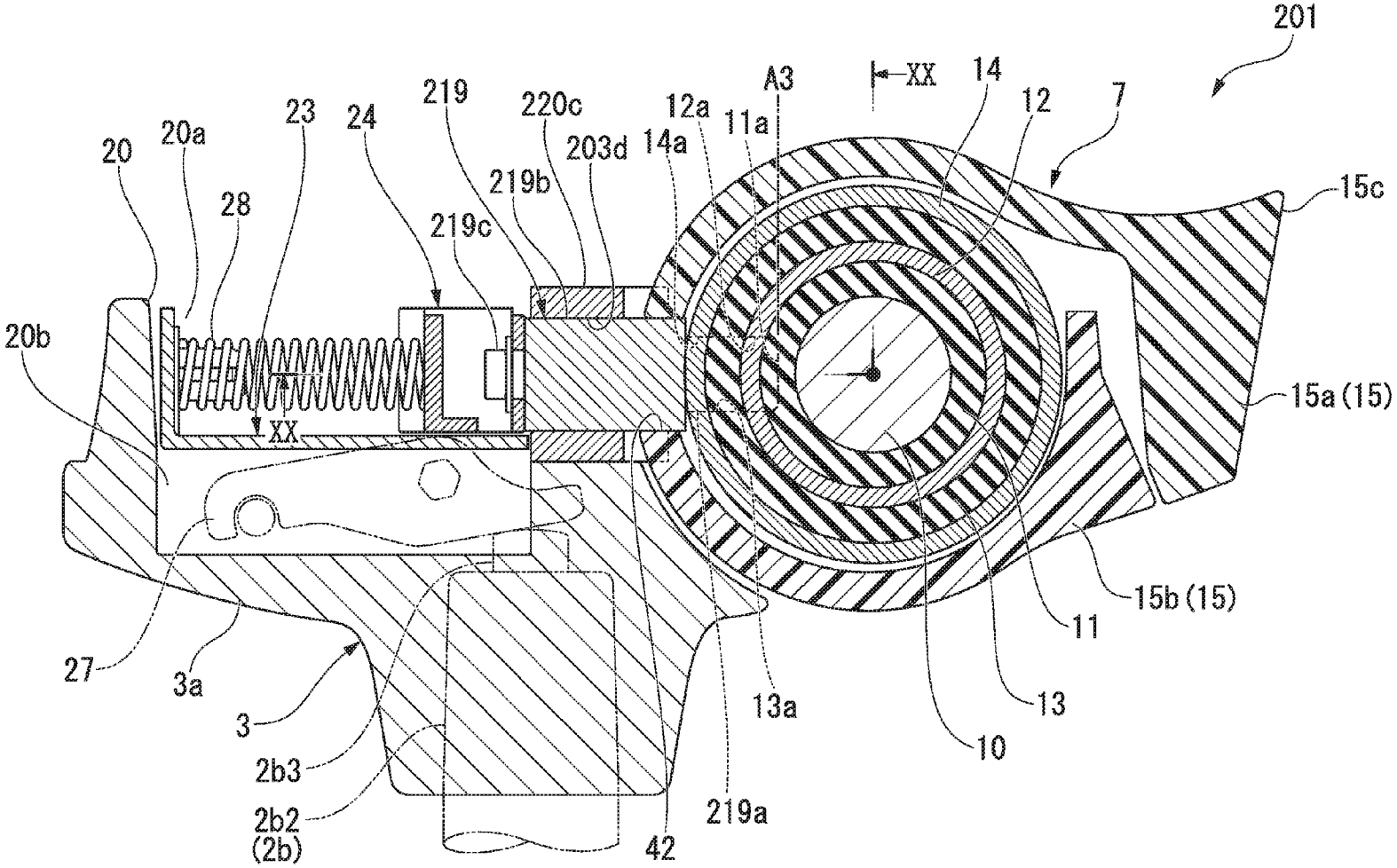
FIG. 21 is a cross-sectional view of the chair according to the third embodiment of the present invention corresponding to a cross section along XXI-XXI of FIG. 20.
Figure 22:
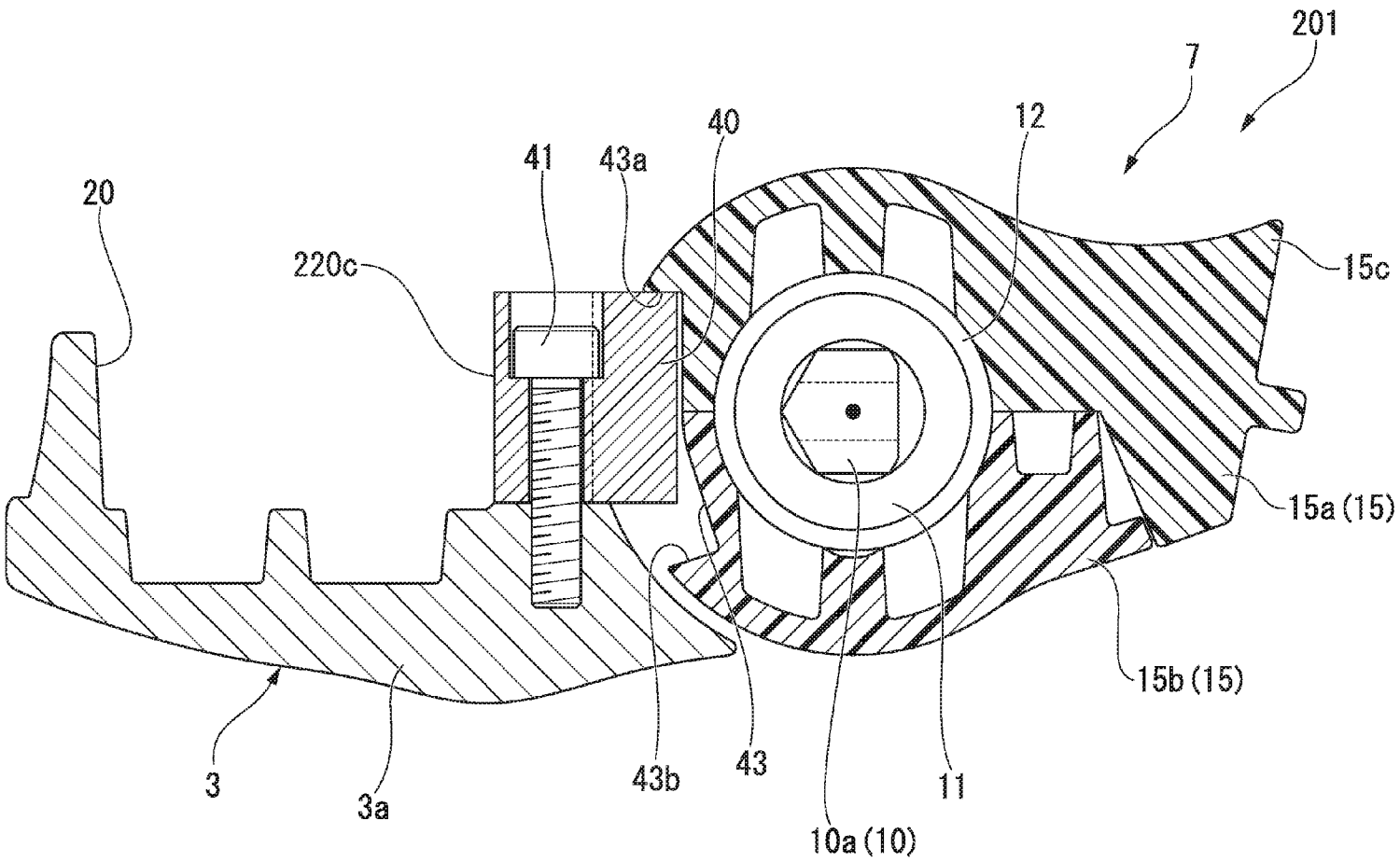
FIG. 22 is a cross-sectional view of the chair according to the third embodiment of the present invention corresponding to a cross section along XXII-XXII of FIG. 16.
Figure 23:
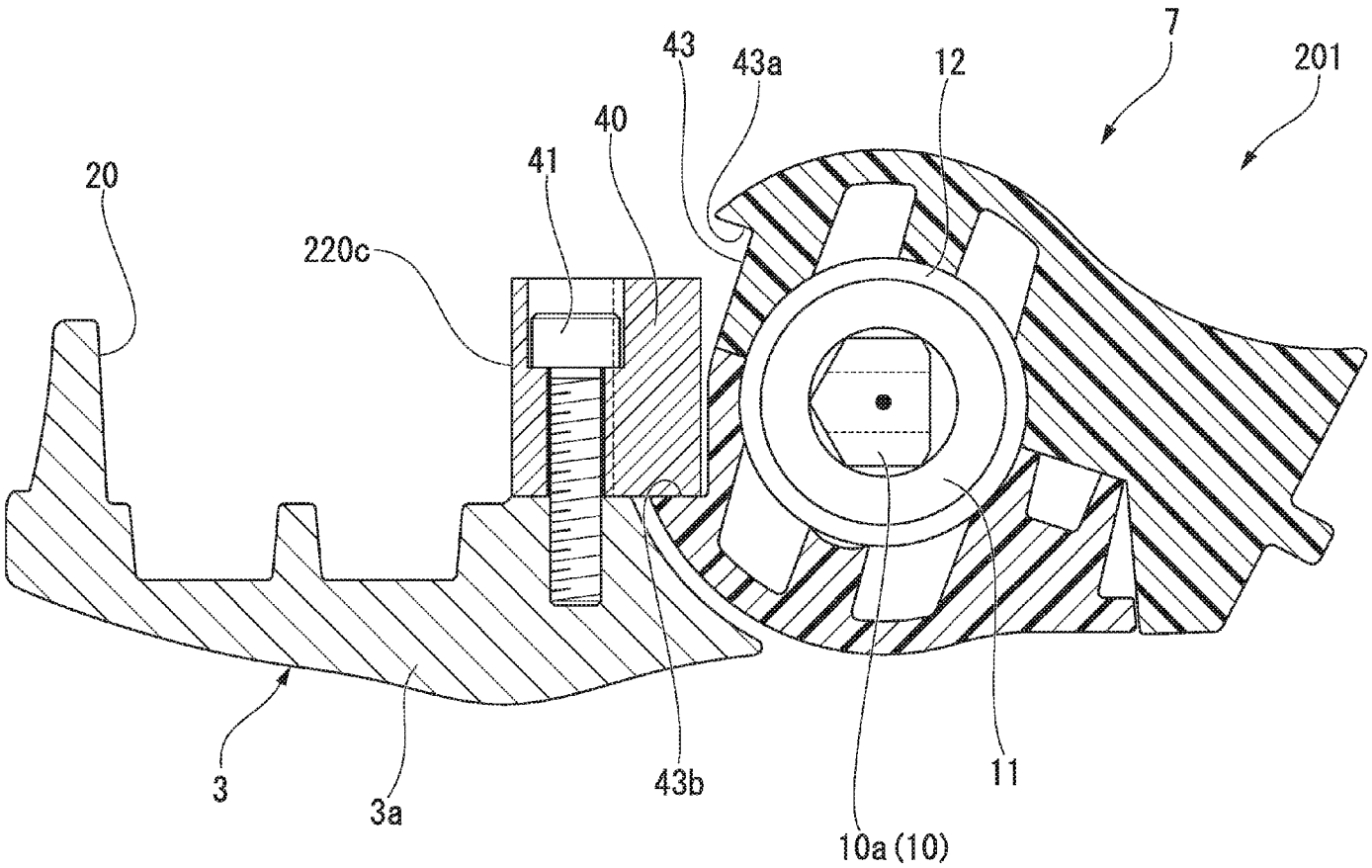
FIG. 23 is a cross-sectional view of the chair according to the third embodiment of the present invention corresponding to the cross section along XXII-XXII of FIG. 16.

Next, a third embodiment shown in FIGS. 14 to 23 will be described. Also, FIG. 14 is an exploded view of a torsion unit 7 and a part of a support base 3 as seen from a front side, and FIGS. 15, 17 and 19 are cross-sectional views corresponding to FIGS. 7, 9 and 10 of the first embodiment. Also, FIG. 16 is a cross-sectional view corresponding to a cross section along XVI-XVI of FIG. 15, and FIGS. 18 and 20 are views corresponding to a cross section along XVIII-XVIII of FIG. 17 and a cross section along XX-XX of FIG. 19. Also, FIG. 21 is a cross-sectional view corresponding to a cross section along XXI-XXI of FIG. 20, and FIGS. 22 and 23 are cross-sectional views corresponding to a cross section along XXII-XXII of FIG. 16.

A chair 201 according to the third embodiment has the same basic constitutions as the first embodiment in which a torsion unit 7 (reaction force mechanism) includes a pivot shaft 10, an inner cylinder 12, an outer cylinder 14 and a housing 15, the pivot shaft 10 and the inner cylinder 12 are connected by a first rubber-like elastic member 11, the inner cylinder 12 and the outer cylinder 14 are connected by a second rubber-like elastic member 13, the pivot shaft 10 is integrally coupled to the support base 3 side, the inner cylinder 12 is integrally coupled to the backrest side via the housing 15, and so on.

The third embodiment is different from the first embodiment in that one operation pin 219 is provided and the operation pin 219 has a different shape. However, like in the first embodiment, the operation pin 219 is operated to advance and retract among a first biasing force adjustment position A1 (refer to FIGS. 15 and 16) in which the operation pin is not engaged with either of the inner cylinder 12 and the outer cylinder 14, a second biasing force adjustment position A2 (refer to FIGS. 17 and 18) in which the operation pin 219 is fitted into only the outer cylinder 14 and a lock position A3 (refer to FIGS. 19 and 20) in which rotation of the inner cylinder 12 is locked.

A major difference between the first embodiment and the third embodiment is that, when the operation pin 219 is operated to the lock position A3, the operation pin 219 is fitted to the housing 15 formed integrally with the inner cylinder 12 and the rotation of the inner cylinder 12 is locked.

A holding hole 203*d* having an approximately rectangular shape (approximately rectangular shape of which corners and side portions on both sides are rounded) which is elongated in the left and right direction to slidably hold the operation pin 219 is formed in a rear wall 220*c* of the support base 3. Also, a pair of displacement restricting protrusions 40 which protrude backward are formed to protrude from left and right sides thereof with the holding hole 203*d* of the rear wall 220*c* interposed therebetween. The displacement restricting protrusions 40 are formed to have an approximate rectangular shape of which a cross section in a direction orthogonal to a protruding direction is vertically elongated. The rear wall 220*c* is fixed to a main body of the support base 3 by a bolt 41.

The operation pin 219 includes an enlarged width portion 219*b* of which a cross section is approximately the same as that of the holding hole 203*d*, a small diameter portion 219*a* which coaxially protrudes from one axial end of the enlarged width portion 219*b*, and a locking portion 219*c* which protrudes coaxially from the other axial end of the enlarged width portion 219*b*. The enlarged width portion 219*b* is slidably held in the holding hole 203*d* of the rear wall 220*c*. The small diameter portion 219*a* is formed to have a circular cross section which has a diameter smaller than a smallest width portion (width portion in a height direction) of the enlarged width portion 219*b*. Also, the small diameter portion 219*a* protrudes toward the torsion unit 7 side and may enter radially inside the torsion unit 7. An interlocking member 24 which is biased toward the torsion unit 7 by a pair of coil springs 28 is connected to the locking portion 219*c*. A backrest operating wire (not shown) is connected to the interlocking member 24 like the first embodiment.

Meanwhile, an approximately rectangular fitting hole 42 which is elongated laterally and into which the enlarged width portion 219*b* of the operation pin 219 can be fitted is formed in a front surface of the housing 15 of the torsion unit 7. As precisely shown in FIG. 14, in the fitting hole 42, a caved portion 42*a* which is caved downward in an approximately semicircular shape is continuously provided in a central region on a lower side of a rectangular portion having approximately the same shape as a cross section of the enlarged width portion 219*b* of the operation pin 219. Since the small diameter portion 219*a* of the operation pin 219 is smaller than a minimum width portion of the enlarged width portion 219*b*, the small diameter portion 219*a* can be freely inserted into the fitting hole 42 when the backrest 5 is in an initial position (in an initial posture). However, the caved portion 42*a* is provided to prevent the small diameter portion 219*a* of the operation pin 219 from interfering with the housing 15 when the backrest 5 is tilted largely backward and downward. As shown in FIG. 21, in the housing 15 of the torsion unit 7, the rotation thereof with respect to the support base 3 is locked by fitting the enlarged width portion 219*b* of the operation pin 219 into the fitting hole 42.

Further, locking holes 43 in which the left and right displacement restricting protrusions 40 of the rear wall 220*c* on the support base 3 side are inserted are formed at right and left side positions of the side surface of the housing 15 with the fitting hole 42 interposed therebetween. A separation width in a vertical direction inside the locking hole 43 is set to be sufficiently larger than a height of the displacement restricting protrusion 40. As shown in FIGS. 22 and 23, when the housing 15 is largely rotated and displaced vertically together with the backrest, the displacement restricting protrusion 40 is in contact with an inner surface of the locking hole 43, and thus the locking hole 43 restricts the tilt of the backrest 5. Further, FIG. 22 shows a state in which the backrest 5 rotates maximally in a direction of the initial position (direction of a standing posture) and an upper side surface 43*a* of the locking hole 43 is in contact with an upper surface of the restriction protrusion 33. FIG. 23 shows a state in which the backrest 5 rotates maximally backward and downward and a lower side surface 43*b* of the locking hole 43 is in contact with a lower surface of the restriction protrusion 33.

Further, when the torsion unit 7 is assembled to the support base 3, both ends 10*a* of the pivot shaft 10 of the torsion unit 7 are fitted into the fitting groove 3*a*4 corresponding to the support base 3 side to prevent relative rotation. Then, the first rubber-like elastic member 11 is twisted by a predetermined amount by rotating the housing 15 formed integrally with the inner cylinder 12 in a direction in which the backrest 5 is tilted backward, and in this state, the displacement restricting protrusion 40 on the support base 3 side is fitted into the locking hole 43 of the housing 15. Accordingly, as shown in FIG. 22, the upper side surface 43*a* of the locking hole 43 of the housing 15 receives the reaction force of the first rubber-like elastic member 11 and comes in contact with the upper surface of the displacement restricting protrusion 40. When the torsion unit 7 is assembled in this way, the rotation of the backrest 5 is restricted in the initial position (initial posture) in a state in which the first rubber-like elastic member 11 is twisted and the initial reaction force is stored.

Fitting holes 14*a* and 12*a* into which small diameter portions 219*a* of operation pins 219 can be fitted are formed in the outer cylinder 14 and the inner cylinder 12 of the torsion unit 7, respectively. Also, escape holes 13*a* and 11*a* for allowing the small diameter portion 219*a* of the operation pin 219 to enter are formed in the second rubber-like elastic member 13 and the first rubber-like elastic member 11.

Further, in the third embodiment, since the operation pin 219 is fitted into the housing 15 and thus the tilt of the backrest is locked as will be described later in detail, the fitting hole 12*a* of the inner cylinder 12 may have a diameter slightly larger than that of the small diameter portion 219*a* of the operation pin 219. Also, when the small diameter portion 219*a* of the operation pin 219 has a length which does not interfere with an outer surface of the inner cylinder 12 and the small diameter portion 219*a* when the operation pin 219 protrudes maximally, the fitting hole 12*a* may not be provided in the inner cylinder 12.

In the case of the embodiment, the pivot shaft 10 constitutes a first shaft member, the inner cylinder 12 and the housing 15 constitute a second shaft member, and the outer cylinder 14 constitutes a third shaft member.

When the tilt reaction force of the backrest is set to "weak," the operation pin 219 supported by the support base 3 is operated to advance and retract to a first biasing force adjustment position A1 shown in FIGS. 15 and 16. At this time, since the operation pin 219 is not engaged with either of the outer cylinder 14 and the inner cylinder 12, the first rubber-like elastic member 11 interposed between the pivot shaft 10 and the inner cylinder 12 is twisted when the housing 15 and the inner cylinder 12 rotate together with the backrest, and at this time, the first rubber-like elastic member 11 generates the reaction force. Further, at this time, since the outer cylinder 14 should follow the rotation of the inner cylinder 12, the second rubber-like elastic member 13 interposed between the inner cylinder 12 and the outer cylinder 14 does not generate the reaction force. Therefore, only a base reaction force resulting from the first rubber-like elastic member 11 acts on the backrest.

Further, when the tilt reaction force of the backrest is set to "strong," the operation pin 219 supported by the support base 3 is operated to advance and retract to a second biasing force adjustment position A2 shown in FIGS. 17 and 18. At this time, since the operation pin 219 is fitted into the fitting hole 14*a* of the outer cylinder 14, the rotation of the outer cylinder 14 is restricted. Therefore, when the backrest is tilted, the inner cylinder 12 rotates relative to the pivot shaft 10 of which the rotation is stopped and the outer cylinder 14, and the first rubber-like elastic member 11 and the second rubber-like elastic member 13 are twisted and deformed. As a result, the reaction force resulting from the second rubber-like elastic member 13 is added to the base reaction force resulting from the first rubber-like elastic member 11, and thus the total reaction force acts on the backrest.

Further, when the tilt of the backrest is locked, the operation pin 219 supported by the support base 3 is operated to advance and retract to a lock position A3 shown in FIGS. 19 and 20. At this time, the small diameter portion 219*a* of the operation pin 219 is fitted into the fitting hole 12*a* of the inner cylinder 12 and the fitting hole 14*a* of the outer cylinder 14, and the enlarged width portion 219*b* is fitted into the fitting hole 42 of the housing 15. As a result, the tilt of the backrest formed integrally with the housing 15 is locked.

As described above, like in the first embodiment, the torsion unit 7 used in the chair 201 according to the third embodiment restricts the rotation of the outer cylinder 14 by displacing the operation pin 219 from the first biasing force adjustment position A1 to the second biasing force adjustment position A2. Therefore, the reaction force resulting from the second rubber-like elastic member 13 is added to the base reaction force resulting from the first rubber-like elastic member 11, and thus the reaction force acting on the backrest 5 can be increased. Therefore, even when an axial space secured by the torsion unit 7 is limited, an axial length of each of the first rubber-like elastic member 11, the inner cylinder 12, the second rubber-like elastic member 13 and the outer cylinder 14 can be sufficiently secured, and the torsion unit 7 which can easily change the reaction force can be obtained without a high degree of design accuracy.

However, since the torsion unit 7 according to the third embodiment has a structure in which the tilt of the backrest is locked by fitting the operation pin 219 into the housing 15 located at an outermost circumference of the torsion unit 7, an excessive load can be prevented in advance from acting on the inner cylinder 12 having a small diameter. Therefore, performance of the torsion unit 7 at the time of shipment can be maintained over a long period of time.

Next, a fourth embodiment shown in FIG. 12 will be described.

Figure 24:
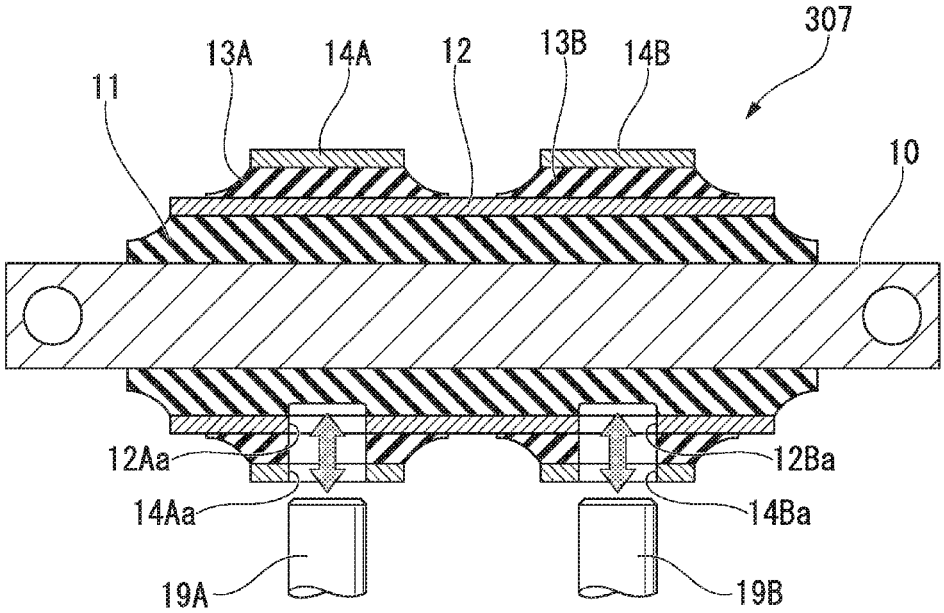
FIG. 24 is a cross-sectional view taken along an axial direction of a reaction force mechanism (torsion unit) according to the third embodiment of the present invention.

FIG. 24 is a view showing a cross section of a torsion unit 307 (reaction force mechanism) according to a fourth embodiment which is cut in an axial direction.

In the torsion unit 307 according to the fourth embodiment, an inner cylinder 12 is disposed radially outside of a pivot shaft 10, and two outer cylinders 14A and 14B are arranged radially outside the inner cylinder 12 in parallel with each other in the axial direction. The pivot shaft 10 and the inner cylinder 12 are connected by the first rubber-like elastic member 11, and the inner cylinder 12 and each of the outer cylinders 14A and 14B are connected by second rubber-like elastic members 13A and 13B.

Two operation pins 19A and 19B constituting a reaction force adjusting part are provided to correspond to the outer cylinders 14A and 14B. Fitting holes 14Aa and 14Ba in which the operation pins 19A and 19B can be fitted are formed in the outer cylinders 14A and 14B, respectively, and fitting holes 12Aa and 12Ba in which the operation pins 19A and 19B can be fitted are formed in the inner cylinder 12.

For example, the torsion unit 307 according to the fourth embodiment is used in a state in which the pivot shaft 10 is integrally coupled to a support structure (supporting member) such as a support base and the inner cylinder 12 is integrally coupled to the backrest (supported member).

In the torsion unit 307, when a weak reaction force is obtained, the operation pins 19A and 19B are displaced at positions at which the operation pins are not engaged with either of the inner cylinder 12 and the outer cylinders 14A and 14B. When a medium reaction force is obtained, one operation pin 19A is displaced to a position in which the one operation pin 19A is fitted to the fitting hole 14Aa of the outer cylinder 14A. When a stronger reaction force is obtained, the two operation pins 19A and 19B are displaced at positions in which the two operation pins are fitted into the fitting holes 14Aa and 14Ba of the corresponding outer cylinders 14A and 14B.

That is, when the operation pins 19A and 19B are in positions in which the operation pins are not engaged with either of the outer cylinders 14A and 14B and the inner cylinder 12, the first rubber-like elastic member 11 generates a base reaction force by itself.

When the one operation pin 19A is in the position in which the one operation pin is fitted into the fitting hole 14Aa of the outer cylinder 14A, rotation of one outer cylinder 14A is locked, and one second rubber-like elastic member 13A generates the reaction force. As a result, a base reaction force resulting from one second rubber-like elastic member 13A is added to that resulting from the first rubber-like elastic member 11.

When the two operation pins 19A and 19B are in positions in which the two operation pins are fitted into the fitting holes 14Aa and 14Ba of the corresponding outer cylinders 14A and 14B, rotation of the two outer cylinders 14A and 14B is locked, and the two second rubber-like elastic members 13A and 13B generate the reaction force. As a result, the base reaction force resulting from the two second rubber-like elastic members 13A and 13B is added to that of the first rubber-like elastic member 11.

Therefore, the torsion unit 307 according to the fourth embodiment can adjust the reaction force in three stages without an increase in an axial length or an outer diameter.

Also, in the case of the torsion unit 307, the tilt of the backrest can be locked by fitting at least one of the operation pins 19A and 19B into the fitting holes 12Aa and 12Ba of the inner cylinder.

Finally, a fifth embodiment shown in FIG. 25 will be described.

Figure 25:
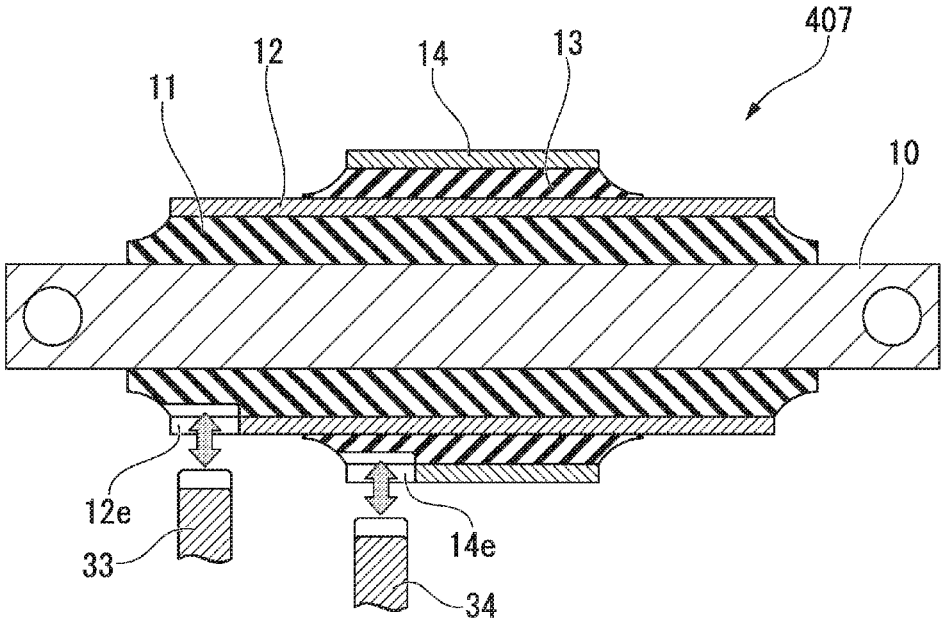
FIG. 25 is a cross-sectional view taken along an axial direction of a reaction force mechanism (torsion unit) according to a fourth embodiment of the present invention.

FIG. 25 is a view showing a cross section of a torsion unit 407 (reaction force mechanism) according to a fifth embodiment which is cut in an axial direction.

In the torsion unit 407 according to the fifth embodiment, an inner cylinder 12 is coupled to an outside of a pivot shaft 10 in a radial direction via a first rubber-like elastic member 11, and a second rubber-like elastic member 13 is coupled to an outside of the inner cylinder 12 in a radial direction. For example, the torsion unit 407 is used in a state in which the pivot shaft 10 is coupled to a support structure (supporting member) such as a support base and the inner cylinder 12 is coupled to the backrest (supported member). Additionally, gear teeth 12*e* and 14*e* are provided on an outer circumferential surface of the inner cylinder 12 and an outer circumferential surface of the outer cylinder 14, respectively, and an operation gear (restriction protrusion) 33 which can be displaced forward and backward and an operation gear (reaction force adjusting part) 34 may be engaged with the gear teeth 12*e* and 14*e*.

In the torsion unit 407 according to the fifth embodiment, when a weak reaction force is obtained, the operation gears 33 and 34 are separated from the inner cylinder 12 and the outer cylinder 14. Accordingly, the outer cylinder 14 rotates following the inner cylinder 12, and the first rubber-like elastic member 11 generates a base reaction force by itself.

Further, when a strong reaction force is obtained, the operation gear 34 is engaged with the gear teeth 14*e* of the outer cylinder 14. Therefore, rotation of the outer cylinder 14 is locked, and the second rubber-like elastic member 13 also generates the reaction force together with the first rubber-like elastic member 11.

Further, when the tilt of the backrest is locked, the operation gear 33 is engaged with the gear teeth 12*e* of the inner cylinder 12. Therefore, relative rotation between the pivot shaft 10 and the inner cylinder 12 is locked.

In addition, the present invention is not limited to the above-described embodiments, and various design changes are possible without departing from the gist thereof. For example, although the pivot, the inner cylinder and the outer cylinder constitute a three-layer shaft member in the embodiments, the number of the shaft members arranged in the radial direction may be more if three or more layers are provided.

INDUSTRIAL APPLICABILITY

According to the present invention, a reaction force mechanism which does not require a high degree of design accuracy and in which the reaction force acting between a supporting member and a supported member can be easily changed, and a chair using the same can be provided.

REFERENCE SIGNS LIST

1, 101, 201 Chair
3 Support base (support structure, supporting member)
5 Backrest (supported member)
7, 307, 407, 507 Torsion unit (reaction force mechanism)
10 Pivot shaft (first shaft member, shaft member)
11 First rubber-like elastic member (biasing member)
12 Inner cylinder (second shaft member, shaft member)
13, 13A, 13B Second rubber-like elastic member (biasing member)
14, 14A, 14B Outer cylinder (third shaft member, shaft member)
19, 19A, 19B Operation pin (reaction force adjusting part)
34 Operation gear (reaction force adjusting part)

The invention claimed is:

1. A reaction force mechanism which is provided between a supporting member and a supported member supported by the supporting member to be tiltable and is capable of adjusting a reaction force resulting from the tilting movement of the supported member with respect to the supporting member, comprising:

a plurality of shaft members including a first shaft member connected to the supporting member, a second shaft member connected to the supported member and a third shaft member other than the first shaft member and the second shaft member and disposed coaxially and radially in multiple layers, the plurality of shaft members being radially disposed in multiple layers and coaxially disposed;

a plurality of biasing members configured to connect radially adjacent shaft members among the plurality of the shaft members in a radial direction; and a reaction force adjusting part configured to increase the reaction force against a base reaction force resulting from a biasing member interposed between the first shaft member and the second shaft member among the plurality of biasing members by restricting rotation of the third shaft member with respect to the first shaft member or the second shaft member.

2. The reaction force mechanism according to claim 1, wherein the first shaft member is constituted by a shaft member in an innermost layer, the second shaft member is constituted by a shaft member disposed radially outside the first shaft member to be adjacent thereto, the third shaft member is constituted by a shaft member disposed radially outside the second shaft member to be adjacent thereto, and the reaction force adjusting part capable of adjusting rotation of the third shaft member is provided at the supporting member.

3. The reaction force mechanism according to claim 2, wherein an axial length of one of the plurality of shaft members which is disposed radially inward is set to be longer than that of the shaft member which is disposed radially outward.

4. The reaction force mechanism according to claim 1, wherein the second shaft member is constituted by a shaft member in an innermost layer, the third shaft member is constituted by a shaft member disposed radially outside the second shaft member to be adjacent thereto, the first shaft member is constituted by a shaft member disposed radially outside the third shaft member to be adjacent thereto, and the reaction force adjusting part capable of adjusting rotation of the third shaft member is provided at the supporting member.

5. The reaction force mechanism according to claim 4, wherein an axial length of one of the plurality of shaft members which is disposed radially inward is set to be longer than that of the shaft member which is disposed radially outward.

6. The reaction force mechanism according to claim 5, wherein the biasing member is an elastic member which is filled between the shaft members radially adjacent to each other and bonded to the shaft members disposed radially inward and outward.

7. The reaction force mechanism according to claim 1, wherein an axial length of one of the plurality of shaft members which is disposed radially inward is set to be longer than that of the shaft member which is disposed radially outward.

8. The reaction force mechanism according to claim 1, wherein the biasing member is an elastic member which is filled between the shaft members radially adjacent to each other and bonded to the shaft members disposed radially inward and outward.

9. The reaction force mechanism according to claim 8, wherein an outer end surface of the elastic member in an axial direction is inclined axially outward with respect to a direction orthogonal to the axial direction.

10. A chair in which a backrest is attached to a support structure to be tilted, wherein the backrest is attached to the support structure via the reaction force mechanism according to claim 9.

11. A chair in which a backrest is attached to a support structure to be tilted, wherein the backrest is attached to the support structure via the reaction force mechanism according to claim 1.

* * * * *